US010982309B2

(12) United States Patent
Kim et al.

(10) Patent No.: US 10,982,309 B2
(45) Date of Patent: Apr. 20, 2021

(54) HOT-ROLLED GALVANIZED STEEL SHEET HAVING EXCELLENT GALLING RESISTANCE, FORMABILITY AND SEALER-ADHESION PROPERTY AND METHOD FOR MANUFACTURING SAME

(71) Applicant: POSCO, Pohang-si (KR)

(72) Inventors: Sang-Heon Kim, Gwangyang-si (KR); Hyeon-Seok Hwang, Gwangyang-si (KR); Suk-Kyu Lee, Gwangyang-si (KR); Sun-Ho Jeon, Gwangyang-si (KR); Yon-Kyun Song, Gwangyang-si (KR); Bong-Hwan Yoo, Gwangyang-si (KR)

(73) Assignee: POSCO, Pohang-si (KR)

( * ) Notice: Subject to any disclaimer, the term of this patent is extended or adjusted under 35 U.S.C. 154(b) by 75 days.

(21) Appl. No.: 16/327,426

(22) PCT Filed: Aug. 22, 2017

(86) PCT No.: PCT/KR2017/009134
§ 371 (c)(1),
(2) Date: Feb. 22, 2019

(87) PCT Pub. No.: WO2018/038499
PCT Pub. Date: Mar. 1, 2018

(65) Prior Publication Data

US 2019/0194792 A1 Jun. 27, 2019

(30) Foreign Application Priority Data

Aug. 22, 2016 (KR) ..... 10-2016-0106001

(51) Int. Cl.

| | |
|---|---|
| ***C23C 2/28*** | (2006.01) |
| ***C23C 2/02*** | (2006.01) |
| ***C23C 2/06*** | (2006.01) |
| ***C23C 2/40*** | (2006.01) |
| ***C23C 2/26*** | (2006.01) |
| ***C22C 18/00*** | (2006.01) |
| ***C21D 9/46*** | (2006.01) |
| ***C22C 18/04*** | (2006.01) |
| ***C23C 2/20*** | (2006.01) |

(52) U.S. Cl.
CPC ..... *C23C 2/28* (2013.01); *C21D 9/46* (2013.01); *C22C 18/00* (2013.01); *C22C 18/04* (2013.01); *C23C 2/02* (2013.01); *C23C 2/06* (2013.01); *C23C 2/20* (2013.01); *C23C 2/26* (2013.01); *C23C 2/40* (2013.01)

(58) Field of Classification Search
None
See application file for complete search history.

(56) References Cited

U.S. PATENT DOCUMENTS

| | | | | |
|---|---|---|---|---|
| 4,960,158 | A * | 10/1990 | Yamada | C23C 2/02 148/533 |
| 2006/0269776 | A1 | 11/2006 | Tanaka et al. | |
| 2008/0206592 | A1* | 8/2008 | Kim | C23C 2/16 428/653 |
| 2009/0297881 | A1 | 12/2009 | Maalman et al. | |
| 2010/0304183 | A1 | 12/2010 | Honda et al. | |
| 2015/0030881 | A1 | 1/2015 | Fushiwaki et al. | |
| 2015/0184274 | A1 | 7/2015 | Kakiuchi et al. | |
| 2016/0186282 | A1 | 6/2016 | Han et al. | |
| 2016/0215376 | A1 | 7/2016 | Luther et al. | |

FOREIGN PATENT DOCUMENTS

| | | | | |
|---|---|---|---|---|
| CN | 1211286 | | 3/1999 | |
| CN | 1771348 | | 5/2006 | |
| CN | 101336308 | | 12/2008 | |
| CN | 104099550 | | 10/2014 | |
| CN | 104471093 | | 3/2015 | |
| CN | 105734411 | | 7/2016 | |
| EP | 0905270 | | 8/2004 | |
| EP | 3396008 | | 10/2018 | |
| JP | 56108845 | A * | 8/1981 | C23C 2/06 |
| JP | 03068749 | | 3/1991 | |
| JP | 06256921 | | 9/1994 | |
| JP | 2003055751 | | 2/2003 | |
| JP | 2007314831 | | 12/2007 | |
| JP | 2014019879 | | 2/2014 | |
| JP | 2015017289 | | 1/2015 | |
| KR | 20000043794 | | 7/2000 | |
| KR | 20040059237 | | 7/2004 | |

(Continued)

OTHER PUBLICATIONS

Wang, et al., Analysis of Morphology and Growth Kinetics of Zn—Mn and Zn-0.2wt.%Al—Mn Hot-Dip Galvanizing Coatings, Advanced Materials Research—Materials Processing Technology, AEMT2011, vols. 291-294, Jul. 31, 2011, pp. 233-236.

Japanese Office Action—Japanese Application No. 2019-510445 dated Mar. 24, 2020, citing JP 2007-314831, JP 2003-55751, KR 10-2000-0043794, JP H3-68749, CN 104099550, and US 2016/0215376.

International Search Report—PCT/KR2017/009134 dated Nov. 30, 2017.

(Continued)

*Primary Examiner* — David P Turocy
(74) *Attorney, Agent, or Firm* — Cantor Colburn LLP

(57) ABSTRACT

Disclosed are a hot-rolled galvanized steel sheet having excellent galling resistance and formability, and a method for manufacturing the same. The hot-rolled galvanized steel sheet, includes: a base steel; and a hot-rolled galvanizing layer formed on the surface of the base steel, wherein the hot-rolled galvanizing layer provides a hot-rolled galvanized steel sheet having a Mn crystallite having a size of 10 μm or less between the resin dendrites of zinc that form sequins.

8 Claims, 20 Drawing Sheets

(56) References Cited

FOREIGN PATENT DOCUMENTS

| | | |
|---|---|---|
| KR | 20070029267 | 3/2007 |
| KR | 100742832 | 7/2007 |
| KR | 20080080416 | 9/2008 |
| KR | 20140138256 | 12/2014 |
| KR | 20160078571 | 7/2016 |

OTHER PUBLICATIONS

Chinese Office Action No. 201780051405.X dated Jul. 27, 2020, citing JP2007-314831, CN104099550, EP3396008, US2016215376, JPH-10368749, JP2003055751, KR20000043794, CN101336308, CN105734411, CN104471093, CN1771348, CN1211286, and Wang, et al.

European Search Report—European Application No. 17843919.6, dated May 3, 2019, citing Wang, EP 3 396 008, CN 104 099 550, US 2016/215376 and JP H03 68749.

* cited by examiner

COMPARATIVE EXAMPLE 11 INVENTIVE EXAMPLE 12

HOT-ROLLED GALVANIZED STEEL SHEET HAVING EXCELLENT GALLING RESISTANCE, FORMABILITY AND SEALER-ADHESION PROPERTY AND METHOD FOR MANUFACTURING SAME

TECHNICAL FIELD

The present disclosure relates to a hot-rolled galvanized steel sheet having excellent galling resistance, formability, and sealer-adhesion property.

BACKGROUND ART

According to ASTM A653 and DIN EN10346, a hot-rolled galvanized steel sheet refers to a zinc-plating layer containing 99 or more weight percentage (wt %) of zinc (Zn). Such a hot-rolled galvanized steel sheet is readily manufactured and has a low production price. Accordingly, an application range of the hot-rolled galvanized steel sheet has recently been extended to household appliances and automotive steel sheets.

However, it is known that galling-suppressing characteristics of such a hot-rolled galvanized steel sheet are deteriorated when the hot-rolled galvanized steel sheet is molded. Such galling refers to a phenomenon in which a plating layer is separated from base steel and applied to a mold. Pieces of the plating layer, applied to the mold, cause defects such as scratches in a continuous molding process to deteriorate surface quality of a product. Accordingly, since the product deteriorated in surface quality is considered to be defective, such galling should be prevented.

Although there are various factors affecting galling characteristics, it is known that surface roughness and hardness of a plating layer affect galling characteristics in terms of physical properties of a material. Accordingly, surface roughness and hardness are controlled by various methods to suppress galling.

As another method, according to a method disclosed in Korean Patent Registration No. 10-0742832, a crystal grain may be formed to have a size of 0.1 millimeter (mm) or less. In this case, it is known that galling characteristics are further improved than a large-sized crystal grain.

However, in this case, as the crystal grain decreases in size, an orientation of a {0001} plane increases. When a preferred orientation, in which the {0001} plane is disposed parallel to a horizontal direction of a steel sheet, is increased, there is a risk of brittle fracture at low temperature.

There are many types of sealer adhesive used to assemble rolled steels, to reduce noise, and improve durability in automotive assembly. In general, when an expensive adhesive is used, adhesive properties are improved, but such use may be costly.

DISCLOSURE

Technical Problem

An aspect of the present disclosure is to provide a hot-rolled galvanized steel sheet having excellent galling resistance, excellent formability resulting from a low surface friction coefficient, and an excellent formation property of a steel sheet resulting from an excellent sealer-adhesion property.

Technical Solution

According to an aspect of the present disclosure, a hot-rolled galvanized steel sheet includes a base steel and a hot-rolled galvanizing layer disposed on a surface of the base steel. The hot-rolled galvanizing layer contains 0.1 to 0.8 weight percentage (wt %) of aluminum (Al), 0.05 to 1 wt % of manganese (Mn), with a remainder of zinc (Zn) and inevitable impurities. A surface of the hot-rolled galvanizing layer is provided with a crystallite having a major axis length of 1 to 20 micrometers (μm).

The hot-rolled galvanizing layer may include an oxide film, having a thickness of 0.005 to 0.02 μm, on the surface of the hot-rolled galvanizing layer.

The crystallite may include 2 to 11 atomic percentage (at %) of Al, 0.6 to 6 at % of Mn, 0 to 2 at % of iron (Fe), and a remainder of Zn.

In the crystallite, Mn and Al may be present together and, in detail, an atomic percentage ratio of Mn and Al (Mn/Al) may range from 0.2 to 0.6.

The oxide film may include 0.5 to 2 wt % of an Al oxide when the Al oxide is converted to Al and 0.05 to 0.2 wt % of a Mn oxide when the Mn oxide is converted to Mn.

A content of Mn in the hot-rolled galvanizing layer, analyzed using a glow discharge mass spectrometer, may be that a maximum Mn concentration within a section from a surface portion of a plating layer to a point of $t \times 1/10$ in a thickness direction on the basis of a plating layer thickness t is 110 to 500% higher than a Mn minimum concentration within a section from a point below the point of $t \times 1/10$ to a boundary between the plating layer and the base steel.

The hot-rolled galvanizing layer may have a spangle having a size of 100 to 400 μm.

The hot-rolled galvanizing layer may include 0.15 to 0.5 wt % of Al and 0.05 to 0.6 wt % of M and, in detail, a total content of Al and Mn may be 1 wt % or less.

In detail, the hot-rolled galvanizing layer may have a surface friction coefficient of 0.10 to 0.14.

In detail, the hot-rolled galvanizing layer may have hardness of 90 to 130 Vickers hardness (Hv).

The hot-rolled galvanizing layer may further include one or more elements selected from titanium (Ti), calcium (Ca), manganese (Mg), nickel (Ni), and antimony (Sb) in such a manner that a total content of the one or more elements is 1% or less (excluding zero).

A difference in height between a mountain and a valley of the hot-rolled galvanizing layer may less than or equal to 20% of a thickness of the hot-rolled galvanizing layer.

According to an aspect of the present disclosure, a method for manufacturing a hot-rolled galvanized steel sheet includes a plating layer forming step of depositing a steel sheet in a hot-rolled galvanizing solution, containing 0.1 to 0.8 weight percentage (wt %) of aluminum (Al), 0.05 to 1 wt % of manganese (Mn), with a remainder of zinc (Zn) and inevitable impurities, and taking out the deposited steel sheet therefrom to form a plating layer that forms a hot-rolled galvanizing layer, a primary cooling step of cooling the steel sheet, on which the hot-rolled galvanizing layer is formed, at a cooling rate of −10 degrees Celsius per second (° C./s) until a temperature of the steel sheet reaches 420° C., a secondary cooling step of cooling the steel sheet at a cooling rate of −8° C./s until the temperature of the steel sheet reaches 418° C. from 420° C., and a tertiary cooling step of cooling the steel sheet at a steel sheet temperature of 418° C. or less at a cooling rate of −10° C./s or more to form the hot-rolled galvanizing layer.

In detail, the hot-rolled galvanizing solution may have a temperature of 440 to 470° C.

The method may further include a wiping step of blowing nitrogen or air to the steel sheet, taken out from the hot-rolled galvanizing solution, to remove excessive molten zinc adhered to the steel sheet while cooling the steel sheet.

In detail, the secondary cooling step may be performed by blowing a gas having a temperature ranging from 100° C. to 400° C. In this case, the gas may be air or a nitrogen gas.

The method may further include cleaning a surface of the steel sheet to remove foreign substances before the plating layer forming step, annealing the steel sheet in a nitrogen-hydrogen reducing atmosphere at an A3 transformation temperature or higher, and cooling the annealed steel sheet before being deposited in the hot-rolled galvanizing solution.

The method may further include temper-rolling a surface of a solidified hot-rolled galvanizing layer after the tertiary cooling step.

The hot-rolled galvanizing solution may contain 0.15 to 0.5 wt % of Al, 0.05 to 0.6 wt % of Mn, and a remainder of Zn, and a total content of elements excluding Zn may be 1 wt % or less.

Advantageous Effects

As set forth above, according to an exemplary embodiment in the present disclosure, a plating layer has excellent galling resistance, formability, and sealer-adhesion properties due to low surface friction coefficient thereof. Thus, the plating layer is appropriate as hot-rolled galvanized steel sheet for automotive applications.

DESCRIPTION OF DRAWINGS

FIG. 2 illustrates an inventive example of the present disclosure, and FIG. 3 illustrates a comparative example.

FIG. 4 illustrates an inventive example of the present disclosure, and FIG. 5 illustrates a comparative example.

FIG. 6 illustrates an inventive example of the present disclosure, and FIG. 7 illustrates a comparative example.

FIG. 8 illustrates an inventive example of the present disclosure, and FIG. 9 illustrates a comparative example.

BEST MODE FOR INVENTION

The present disclosure provides a hot-rolled galvanized steel sheet having excellent galling resistance. To this end, the present disclosure provides a hot-rolled galvanized steel sheet in which a hot-rolled galvanizing layer containing a predetermined amount of manganese (Mn) is formed.

In general, a hot-rolled galvanized steel sheet is susceptible to the occurrence of a unique coating texture aspect, called a spangle (or sequin) or flower pattern. The occurrence of such spangles is due to characteristics of solidification reaction of zinc. For example, when zinc is solidified, resin dendrites in the form of the branches of a tree grow from a solidification nucleus as a starting point to form a skeletal structure of the coating texture. A non-solidified molten zinc pool, remaining between resin dendrites, solidifies, resulting in completion of solidification of a plating layer.

In hot-rolled galvanization, the solidification nuclei are generated on an interface between the plating layer and base steel. Accordingly, the solidification is performed in a direction of a surface portion of the plating layer on the interface to grow a resin dendrite. Such a resin dendrite affects surface bending of the plating layer. When a material is naturally cooled without separate cooling equipment, a cooling rate is slow. Thus, the resin dendrite tends to be excessively grown to intensify the bending of the plating layer. Such a tendency becomes severe as a plating amount is increased and a thickness of a steel sheet is increased. Accordingly, the cooling rate is advantageously increased to obtain a smooth surface of the plating layer.

Galling resistance and formability of a steel sheet depend on friction between a mold and the steel sheet during stamping. According to an experiment of the present disclosure, it was confirmed that as the amount of manganese (Mn) contained in a plating layer is increased, a friction coefficient value is decreased and the galling resistance is improved. Although the reason for the above is unclear, it is presumed that Mn contained in the plating layer reduces a friction coefficient and Mn is dissolved in Zn in the plating layer such that hardness of the plating layer is increased to improve galling resistance.

Figure 1:
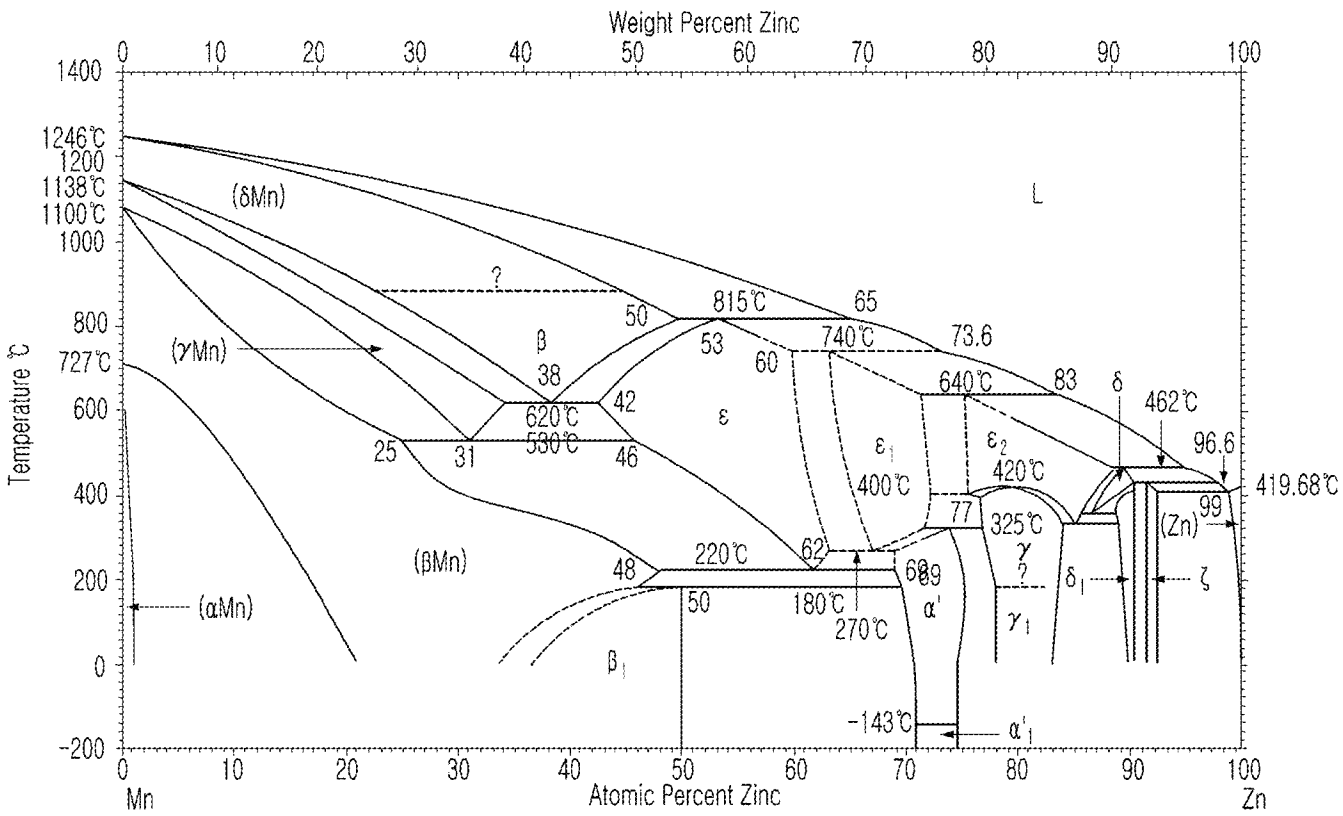
FIG. 1 is an equilibrium phase diagram of zinc and manganese.

When manganese (Mn) is contained a hot-rolled galvanizing layer, the hot-rolled galvanizing layer depicts a Zn—Mn phase diagram, as illustrated in FIG. 1. As can be seen From FIG. 1, a eutectic point of Mn is between 0.5 to 1 wt % and a process temperature is about 410 degrees Celsius (° C.) to about 419° C. When plating is performed in a plating solution containing Mn, a distribution coefficient of Mn to Zn is less than 1. Therefore, if the concentration of Mn becomes greater than or equal to the eutectic point, Mn non-dissolved in a resin dendrite may be discharged to a non-solidified molten zinc to be purged when Zn is solidified.

The higher a growth rate of a resin dendrite, the higher a concentration of Mn at a tip of the resin dendrite. The lower a growth rate of a resin dendrite, the more diffused Mn in the non-solidified molten zinc causes concentration to be reduced at the tip of the resin dendrite.

For example, as a solidification rate is reduced, there is a lot of time to diffuse Mn, released from the resin dendrite, into molten zinc. Accordingly, the concentration of Mn in the molten zinc, remaining in a position distant from the resin dendrite, is increased. As a result, the amount of trace elements present in the surface portion is increased after solidification of the plating layer is completed. Meanwhile, when the solidification rate of the resin dendrite is increased, the concentration of Mn is increased at the tip of the resin dendrite and Mn may be crystallized in the plating layer.

In consideration of the foregoing, it is advantageous to decrease a growth rate of the resin dendrite in terms of surface crystallization of the plating layer. However, in the case of natural cooling without separate cooling equipment, an alloying reaction occurs on the interface with the plating layer during the solidification of the plating layer. Thus, a brittle zinc-iron alloy phase is formed in the steel sheet to deteriorate a sealer-adhesion property. In addition, the resin dendrite is excessively developed to severely bend a surface of the plating layer. Accordingly, the cooling rate needs to be controlled to satisfy both the amount of Mn crystallization on the surface of the plating layer and the surface bending or the sealer-adhesion property of the plating layer.

Accordingly, in the present disclosure, cooling of the plating layer is divided into three stages to control a cooling rate. Specifically, after a surface of a steel sheet is cleaned to remove foreign substances such as rolling oil, iron content, and the like on the surface, the steel sheet is annealed in a nitrogen-hydrogen reducing atmosphere at an A3 transformation temperature or higher. After being cooled, the annealed steel sheet is deposited in a plating bath.

The deposited steel sheet is taken out of the plating bath and cooled to cool and solidify a hot-rolled galvanizing layer formed on the surface of the steel sheet. In this case, the present disclosure proposes that the steel sheet is cooled at a cooling rate of −10° C./s or higher by blowing air in a section before a temperature of the steel sheet reaches at least 420° C., is cooled at a cooling rate ranging from −3° C./s to −8° C./s in a section before the temperature of the steel sheet reaches 420° C. or less to 418° C., and is cooled at a cooling rate of −10° C./s or higher in a section before the temperature of the steel sheet is 418° C. or less.

In detail, a cooling rate of the resin dendrite is decreased to obtain the above concentration distribution of Mn. When the cooling rate is high, the amount of trace elements crystallized on a surface portion is decreased and trace elements are mainly present at crystal grain boundaries. In this case, since the amount of the trace elements crystallized on the surface portion is low, an effect to be obtained from the trace elements is deteriorated, which is not desirable.

According to an experiment, the cooling rate in the section of 420° C. to 418° C. is reduced to be less than −8° C./s, which causes the amount of Mn crystallized on the surface of the plating layer to be increased. Therefore, it is advantageous in terms of improvement in quality. In further detail, as the cooling rate is decreased, the above effect is advantageously obtained. A lower limit of the cooling rate is not limited but is, in detail, −3° C./s or more. The cooling rate of −3° C./s is a rate, at which a steel sheet having a thickness of 0.7 millimeter (mm) is left in the air without a separate cooling treatment to be naturally cooled after being wiped at room temperature in a typical hot-rolled galvanizing process, and a separate heat-retaining treatment is required.

Excessive molten zinc, applied to a steel sheet taken out of a plating pot, may be removed and the steel sheet may be simultaneously cooled by blowing nitrogen or air in the steel sheet. As a method of decreasing a cooling rate without a separate heat-retaining treatment, when a temperature of a wiping gas for controlling a plating amount is set to be 100° C. or more to 400° C. or less, the cooling rate in the section 420° C. to 418° C. may be set to be described above, which is more effective.

According to the present disclosure, a size of a spangle, in detail, a zinc particle, is further increased by controlling the cooling rate to −8° C./s in a steel sheet temperature range of 420° C. to 418° C., as described above. Specifically, the hot-rolled galvanizing layer according to the present disclosure has a spangle size of 100 μm to 400 μm.

As described above, since galling resistance and formability of a steel sheet are affected by friction between a mold and the steel sheet during stamping, the presence of Mn on the surface of the plating layer decreasing a friction coefficient of the plating layer improves, in detail, galling resistance and formability.

From a result of analyzing a concentration distribution of manganese (Mn) in a plating layer using a glow discharge mass spectrometer, the content of Mn in the plating layer is that, in detail, maximum Mn concentration from a surface portion of the plating layer to a point of one-tenth (1/10), directed to a boundary between the plating layer and base steel, is higher than minimum Mn concentration within a range of 110% to 500%, on the basis of a thickness of the plating layer, to improve galling resistance and formability.

A friction coefficient of the plated layer is a property, determined by a surface portion of a steel sheet, and Mn particles crystallized on the surface provide an effect to reduce surface friction. A distribution coefficient K is in proportion to a ratio of a fraction to respective phases α and β under a condition for which a certain component maintains a distribution equilibrium between the two phases α and β.

For example, the above crystallization occurs because the distribution coefficient K of Mn in molten zinc is less than or equal to 1, and a lowest concentration value in the plating layer refers to a concentration of Mn dissolved in a resin dendrite. Accordingly, the presence of a Mn crystallite on the surface leads to a result that the maximum Mn concentration in the surface portion is 110% or more of the lowest Mn concentration value. On the other hand, when a maximum concentration value of the surface is 500% or more, a great number of crystallized matters are formed on the surface. In this case, the friction coefficient of the surface is excessively decreased to cause wrinkles or the like during molding.

Accordingly, in further detail, Mn is located on the surface of the plating layer to improve galling resistance and formability. To this end, a cooling rate is reduced to distribute a large amount of Mn on a surface portion. As limited in the present disclosure, from a result of analyzing a concentration distribution of manganese (Mn) in a plating layer using a glow discharge mass spectrometer, there are sufficient crystallized matters on the surface when a maximum Mn concentration from a surface portion of the plating layer to a point of one-tenth (1/10), directed to a boundary between the plating layer and base steel, is higher than minimum Mn concentration within a range of 110% to 500%, on the basis of a thickness of the plating layer, to improve galling resistance and formability.

The crystallized matter formed on the surface of the hot-rolled galvanizing layer includes a crystallite having a major axis length of 1 μm to 20 μm.

The crystallized matter contains manganese (Mn) and aluminum (Al) together with zinc (Zn), and Mn and Al, contained in the crystallized matter, have a Mn/Al atomic percent ratio of 0.2 to 0.6.

According to the experiments of the present inventors, in a hot-rolled galvanized steel sheet, in detail, a plating layer contains aluminum (Al) together with manganese (Mn). In detail, the content of Mn is in a range of 0.05 to 1 wt %, and Al is contained in a range of 0.1 to 0.8 wt %.

When manganese (Mn) is contained in a hot-rolled galvanizing layer, the hot-rolled galvanizing layer depicts a Zn—Mn phase diagram, as illustrated in FIG. 1. From FIG. 1, since a eutectic point of Mn is between 0.5 wt % and 1 wt %, Mn may be added to a hot-rolled galvanizing solution at a content of 0.05 to 1 wt % that is a range limited in the present disclosure.

When the Mn content is less than 0.05 wt %, there is no effect to improve friction characteristics of a plated surface. On the other hand, when the content of Mn is greater than 1 wt %, there is a slight effect to improve the friction characteristics due to an increase in the Mn concentration and viscosity of the plating solution is increased. Accordingly, since there is a risk of poor appearance of the plating layer, the content of Mn is limited to, in detail, 1 wt % or less.

Aluminum (Al) is added as a component to improve a plating property. In the case in which the content of Al is less than 0.1 wt %, the base steel is considerably eroded by the molten zinc in the plating solution to generate a bottom dross which is an intermetallic compound of zinc and iron. In the case in which the content of Al is greater than 0.8 wt %, weldability may be deteriorated when a steel sheet is welded.

It may be more effective to apply the present disclosure to a hot-rolled galvanized steel sheet (GI steel sheet) prescribed by ASTM and DIN standards. According to the definition of the GI steel sheet, the total weight of aluminum (Al) and manganese (Mn) should not be greater than 1 wt % because zinc (Zn) is contained in an amount of 99 wt % or more and the other components, other than Zn, are contained in an amount of 1 wt % or less. In detail, Mn is contained in an amount of 0.05 to 0.6 wt %, and Al is contained in an amount of 0.15 to 0.5 wt %.

A plating layer of the hot-rolled galvanized steel sheet according to the present disclosure may further include one or more elements selected from titanium (Ti), calcium (Ca), manganese (Mg), nickel (Ni), antimony (Sb), and the like in addition to Mn and Al. A total weight of these elements may be 1 wt % or less. However, in the case of application to a hot-rolled galvanized steel sheet (GI steel sheet) prescribed by the ASTM and DIN standards, the above elements may be further included in such a manner that a total content of the other elements excluding Zn is 1 wt % or less.

The hot-rolled galvanizing layer according to the present disclosure includes an oxide film formed on a surface thereof, and the oxide film is formed to have a thickness ranging from 0.005 μm 0.02 μm. In addition to Zn, the oxide film mainly contains Al oxide and contains a small amount of Mn oxide. Al is oxidized ahead of Mn, and the oxide film on the surface of the hot-rolled galvanizing layer is mainly aluminum oxide. The content of Al oxide, present on the oxide film, may be in the range of 0.5 to 2 wt % when it is converted to the content of Al, and the content of Mn oxide may be in the range of 0.05 to 0.2 wt % when it is converted to the content of Mn.

According to the present disclosure, the presence of Mn on the surface of the hot-rolled galvanizing layer provides an effect to improve a friction coefficient. Thus, a friction coefficient of the surface of the hot-rolled galvanizing layer is low in the range of 0.10 to 0.14. Additionally, the hot-rolled galvanizing layer according to the present disclosure provides a hardness of 90 to 130 Vickers hardness (Hv) due to Mn.

Since the hot-rolled galvanizing layer according to the present disclosure has a flat surface, a difference in height between a mountain and a valley is not great. Specifically, the surface of the hot-rolled galvanizing layer according to the present disclosure has a difference in height between a mountains and a valley within 20% of a thickness of the hot-rolled galvanizing layer.

MODE FOR INVENTION

Embodiment

Hereinafter, embodiments of the present disclosure will be described in more detail with reference to accompanying drawings. However, following embodiments are merely examples of the present disclosure, and the present disclosure is not limited by the embodiments.

Embodiment 1

A cold-rolled steel sheet having a carbon content of 30 ppm and a thickness of 1.6 mm was subjected to surface cleaning in a caustic soda solution having a concentration of 10%, washed with water, and dried. After being annealed to reach a temperature of 820° C., the steel sheet was cooled to 460° C.

Then, the steel sheet was deposited in a plating pot in which a plating solution was deposited. After nitrogen was blown onto the steel sheet, taken out of the plating pot, to adjust a plating amount, a plating layer was solidified.

In this case, a composition of the plating solution was that aluminum (Al) was 0.22 wt % and the amount of manganese (Mn) changed from 0 to 1.1 wt %. A remainder was zinc (Zn) except for inevitable components present in a plating solution.

The solidification of the plating layer was completed at 418° C. A cooling rate in a temperature section of 420° C. to 418° C. was changed when the plating layer was solidified. In the other temperature sections, the plating layer was cooled at a rate of −10° C./s or higher.

In Comparative Example 6, the plating layer was solidified at a cooling rate of −2° C./s by natural cooling throughout the temperature sections after being the wiped.

A component analysis of the plating solution was performed by wet analysis after collecting a sample in the plating solution. The plating layer was deposited in 5% of hydrochloric acid and completely dissolved therein. The solution was analyzed by wet analysis. Analysis results are shown in Table (1).

TABLE (1)

| | | Composition of Plating Solution (wt %) | | Cooling Rate (° C./s) in section | Composition of Plating layer (wt %) | |
|---|---|---|---|---|---|---|
| | | Al | Mn | of 420 to 418° C. | Al | Mn |
| Comparative Example | 1 | 0.18 | 0.01 | −10 | 0.31 | 0.01 |
| | 2 | 0.22 | 0 | −5 | 0.37 | 0 |
| | 3 | 0.22 | 0 | −10 | 0.31 | 0 |
| | 4 | 0.22 | 0 | −5 | 0.33 | 0 |
| | 5 | 0.13 | 0.03 | −3 | 0.34 | 0.03 |
| | 6 | 0.22 | 0.65 | −2 (natural cooling in entire section) | 0.36 | 0.65 |
| | 7 | 0.22 | 1.1 | −3 | — | 1.1 |
| Inventive example | 1 | 0.30 | 0.05 | −5 | 0.31 | 0.05 |
| | 2 | 0.22 | 0.05 | −8 | 0.37 | 0.05 |
| | 3 | 0.15 | 0.2 | −8 | 0.30 | 0.1 |
| | 4 | 0.22 | 0.65 | −5 | 0.32 | 0.65 |
| | 5 | 0.22 | 0.65 | −5 | 0.35 | 0.65 |
| | 6 | 0.30 | 0.9 | −8 | 0.31 | 0.9 |
| | 7 | 0.40 | 0.65 | −3 | 0.33 | 0.65 |

Comparative Examples 1 to 5 correspond to a case in which the Mn content is less than 0.05% which is a range proposed by the present disclosure.

Comparative Example 6 corresponds to a case in which the steel sheet was naturally cooled in the entire section and was slowly cooled at a cooling rate of −2° C./s.

Comparative Example 7 corresponds to a case in which the Mn content is 1.1%, which is higher than an upper limit of 1% proposed in the present disclosure. It was observed that many types of dross adhered to a surface during actual plating to cause a poor appearance of the surface. Therefore, Comparative Example 7 was excluded from the GDS analysis.

Inventive examples 1 to 7 correspond to cases in which plating is performed under the conditions within a range proposed by the present disclosure.

As can be seen from Table (1), a Mn concentration of the plating layer was equal to a Mn concentration of the plating solution.

The prepared sample was analyzed using Glow Discharge Spectrometer (GDS), a model of GDS-850A manufactured by LECO Co. The analysis was performed under the conditions, as follows.

Figure 8:
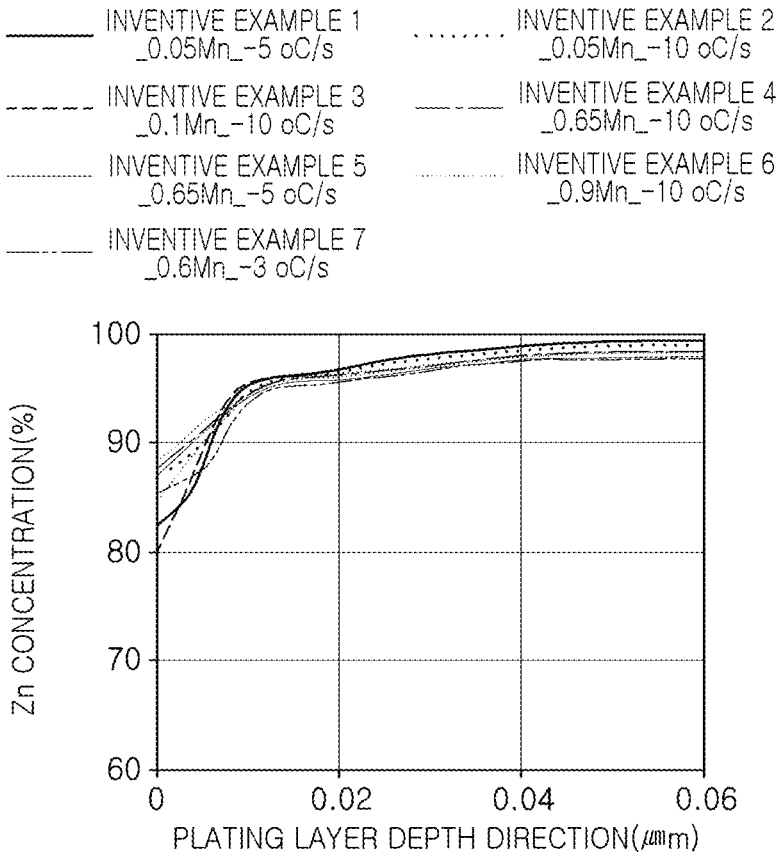
FIGS. 8 and 9 are graphs illustrating zinc (Zn) concentrations, measured from a surface layer portion of a plating layer to a point at 0.06 μm in a depth direction by a GDS, in the plating steel sheet according to the first embodiment.
Figure 9:
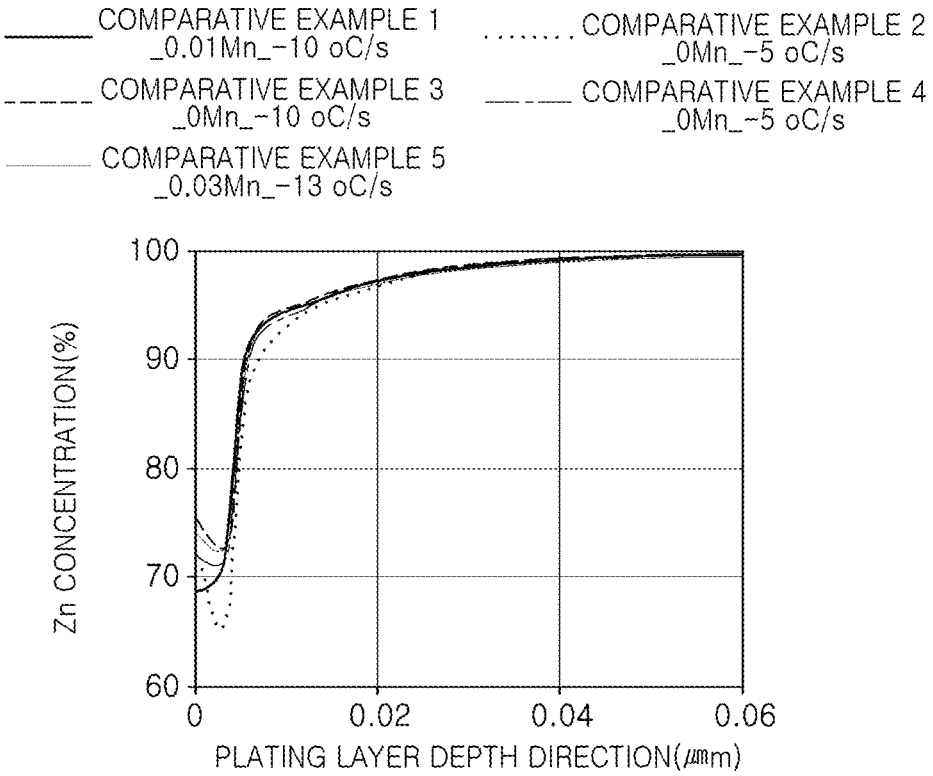

Method: Zn Galv RF
Voltage RMS (Root-Mean-Square): 700 V
Current: 29.99 mA
True Plasma Power: 21 W
Lamp Type: RF (Radio Frequency)
Lamp Size: 4 mm
Export File Conditions: Data points 8000/Smoothing Oxygen concentration, aluminum (Al) concentration, and manganese (Mn) concentration were measured from a surface portion of the plating layer to a point, at which depth is 0.06 μm in a depth direction, and results of the measurement are illustrated in FIGS. 2 to 7, respectively. From FIGS. 8 and 9, it was confirmed that a remainder of the plating layer was zinc (Zn).

Figure 2:
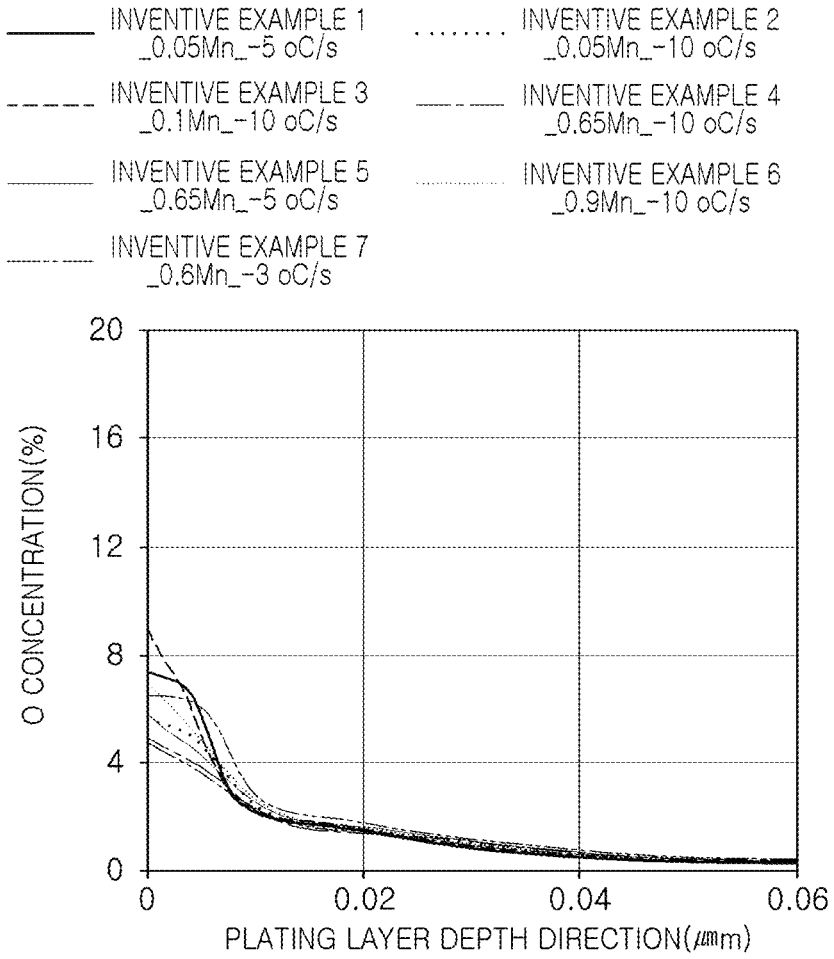
FIGS. 2 and 3 are graphs illustrating oxygen concentrations, measured from a surface layer portion of a plating layer to a point at 0.06 micrometers (μm) in a depth direction by a glow discharge spectrometer (GDS), in a plating steel sheet according to a first embodiment.

Since an oxide film is measured in the surface portion of the plating layer, an oxygen concentration value indicates a peak value. Since the oxide film and the plating layer are analyzed together on a boundary between the oxide film and the plating layer, the oxygen concentration is gradually decreased. For example, an inflection point appears on an oxygen concentration change curve. Accordingly, as illustrated in FIGS. 2 and 3, a point of intersection of two normals, drawn from curves whose boundaries are the inflection point, was defined as a thickness of the oxide film.

Figure 3:
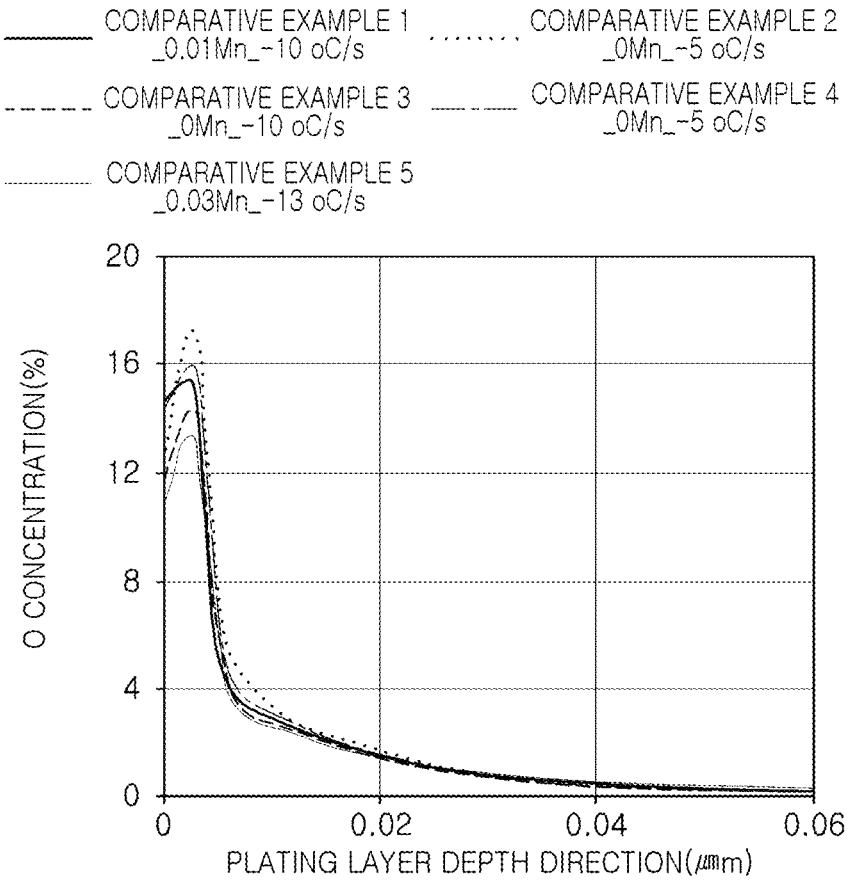

In the case of Comparative Examples 1 to 5 in which Mn was added in an amount of less than 0.05 wt %, as can be seen from FIG. 3, the oxide film had a thickness of about 0.005 μm. Meanwhile, in Examples 1 to 7, as can be seen from FIG. 2, the oxide film has a thickness of about 0.005 to 0.02 μm.

Figure 4:
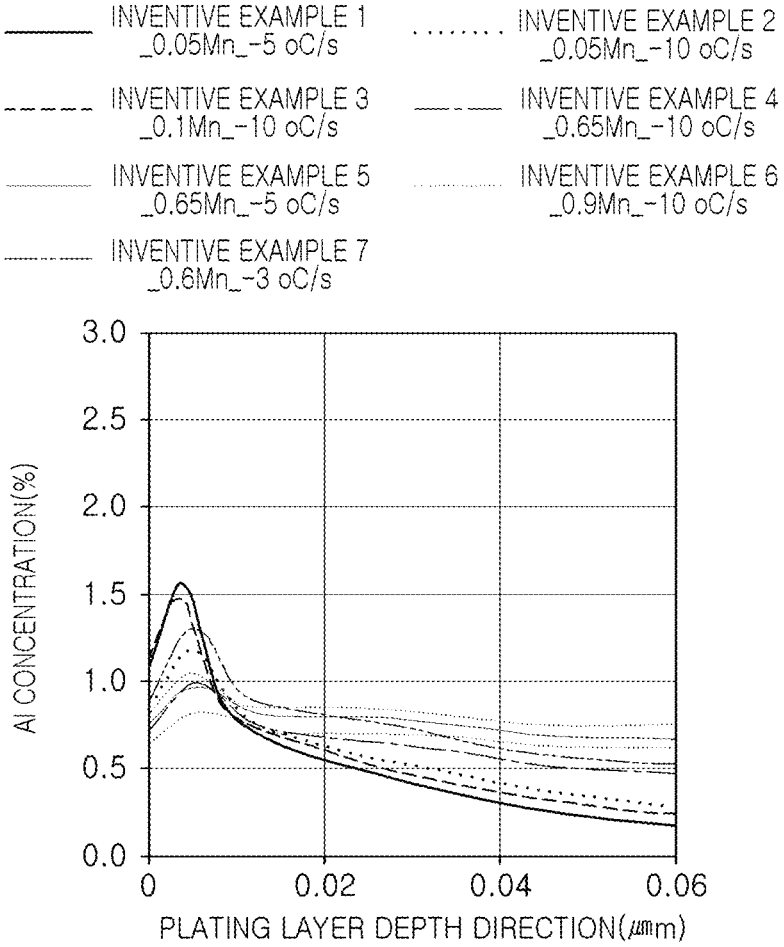
FIGS. 4 and 5 are graphs illustrating aluminum (Al) concentrations, measured from a surface layer portion of a plating layer to a point at 0.06 μm in a depth direction by a GDS, in the plating steel sheet according to the first embodiment.
Figure 5:
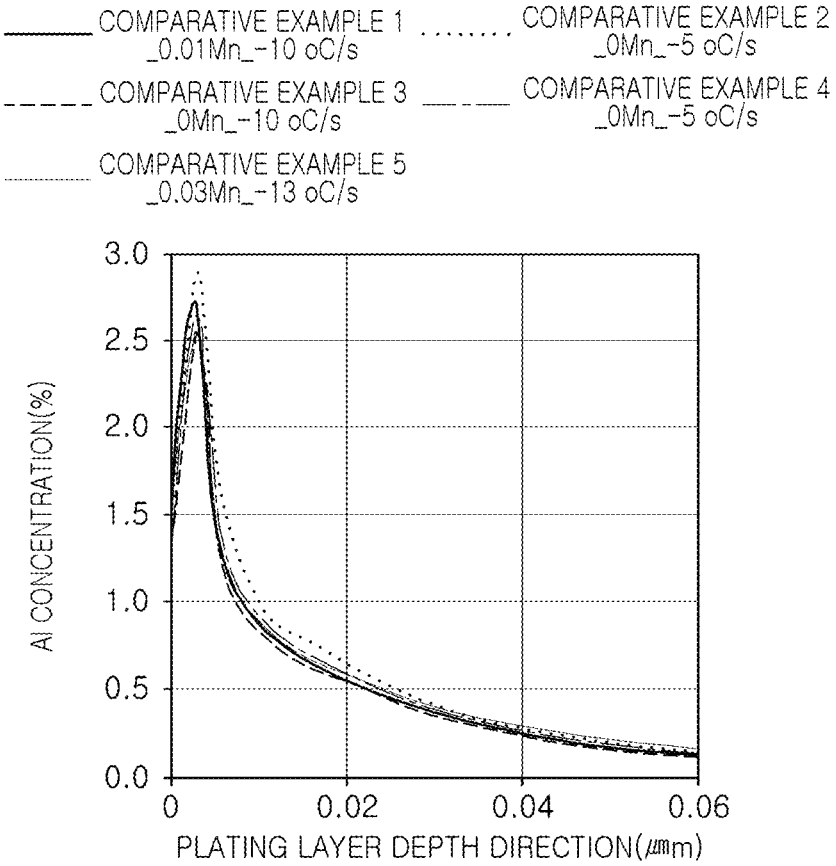

The results of analyzing a concentration of aluminum (Al) in the surface oxide using the GDS are illustrated in FIGS. 4 and 5. As can be seen from FIG. 5, the Al concentration is 2% or more in Comparative Examples 1 to 5. As can be seen from FIG. 4, the Al concentration was 2% or less in Inventive examples 1 to 7.

Figure 6:
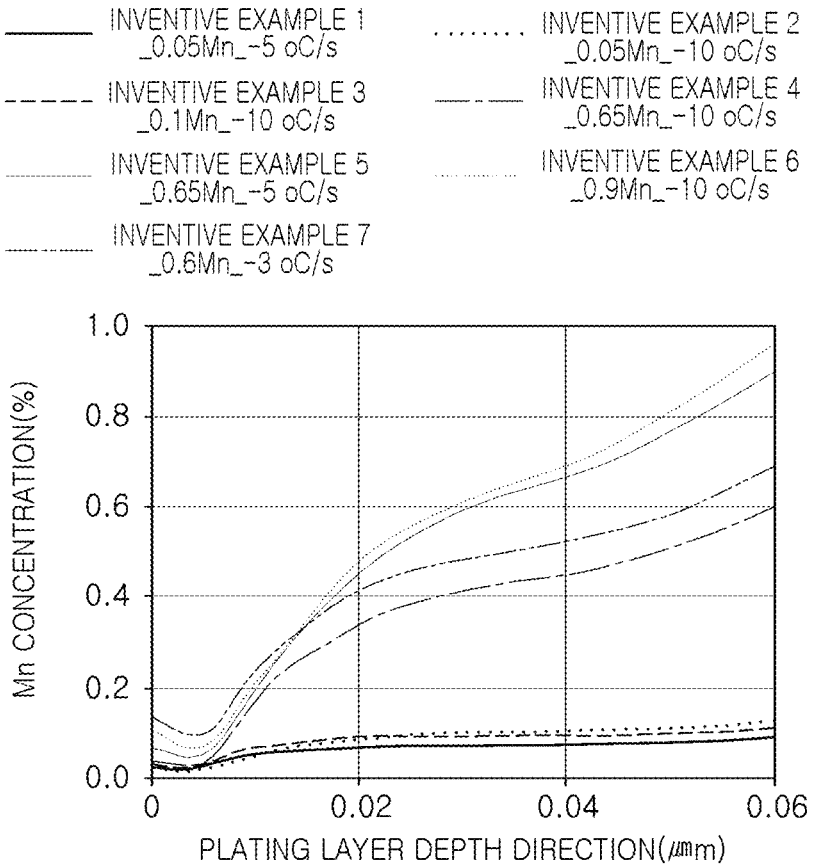
FIGS. 6 and 7 are graphs illustrating manganese (Mn) concentrations, measured from a surface layer portion of a plating layer to a point at 0.06 μm in a depth direction by a GDS, in the plating steel sheet according to the first embodiment.
Figure 7:
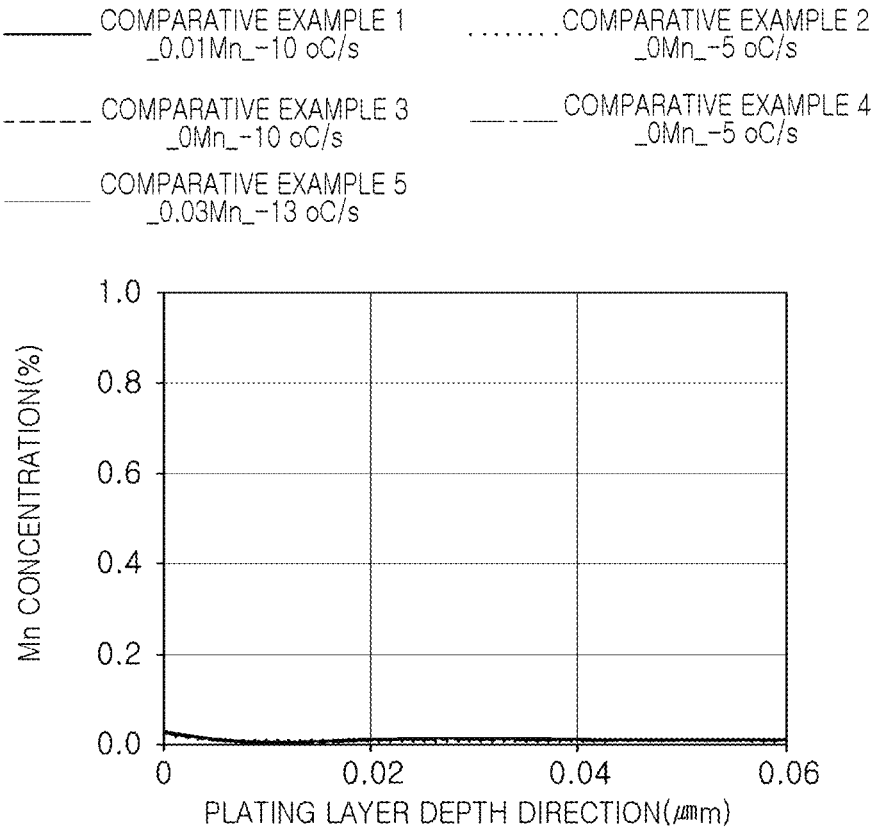

The results of analyzing a concentration of manganese (Mn) in the surface oxide using the GDS are illustrated in FIGS. 6 and 7. As can be seen from FIG. 6, in the case of inventive examples 1 to 7, the content of Mn oxide was in the range of 0.05 to 0.2 wt % when it is converted to the content of Mn.

As illustrated in the composition of the plating layer in Table (1), considering that the content of Mn in the plating layers of the first to seventh embodiments is 0.05 to 1 wt %, it will be understood that an oxide is mainly an aluminum oxide because aluminum (Al) is oxidized ahead of manganese (Mn).

As described above, when hot-rolled galvanization is performed according to the plating conditions of the present disclosure, Mn oxidation barely occurs. This is because a temperature of the plating solution is as low as about 460° C. and the cooling rate is controlled to −8° C./s or less in the section of 418° C. to 420° C., while the temperature is rapidly reduced to −10° C./s or higher in the other temperature sections.

In the case of Comparative Example 6, the oxide film had a thickness of about 0.015 μm, but a steel sheet was naturally cooled from a wiping process to the end of solidification. In this case, a cooling rate was −2° C./s. The result of Comparative Example 6 was compared with a result of Inventive example 4 in which a steel sheet was wiped and cooled at a cooling rate of −10° C./s by blowing air during cooling, and the cooled steel sheet was cooled to 300° C. at a cooling rate of −15° C./s after being cooled at a cooling rate of −3° C./s in a temperature section of 420 to 418° C.

Figure 10:
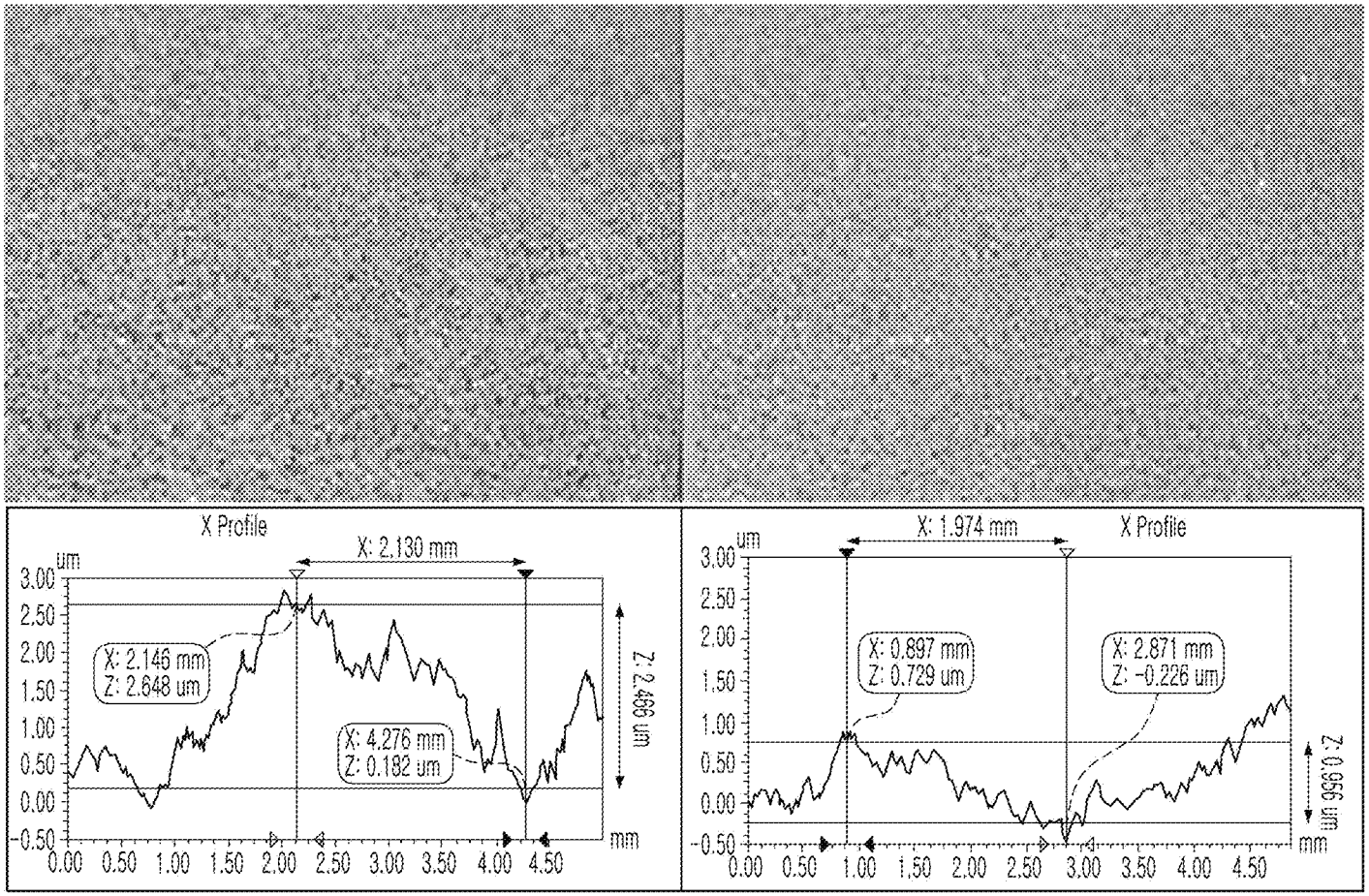
FIG. 10 are scanning electron microscope (SEM) images of surfaces of plating layers, obtained by a sixth comparative example and a fourth inventive example, and graphs illustrating results obtained by measuring a difference in height between two-dimensional bendings for the respective surfaces of the plating layers.

A surface of a plating layer obtained in Comparative Example 6 and a surface of a plating layer obtained in Inventive example 4 were captured, and a height difference of two-dimensional bending on the surfaces was measured, and results thereof are illustrated in FIG. 10. In FIG. 10, a left image is an image obtained by capturing the surface of Comparative Example 6, and a right image is an image obtained by capturing the surface of Inventive example 4.

As can be seen from FIG. 10, in Comparative Example 6 illustrated in the right image, the surface is rough even when viewed with the naked eye and a difference in height between mountains and valleys is about 2.5 μm, which corresponds to about 25% of a plating thickness considering that the amount of a plating material was 10 μm when it was converted to the plating thickness.

In Inventive example 4 illustrated in the left image, the surface is smooth, as compared with Comparative Example 6, which may be confirmed with the naked eye. A difference in height between mountains and valleys is about 1 μm, which corresponds to 10% or less of the thickness of the plating. From this, it can be seen that the plating layer obtained by Inventive example 4 has less surface bending and is more level than the case of natural cooling of Comparative Example 6.

Figure 11:
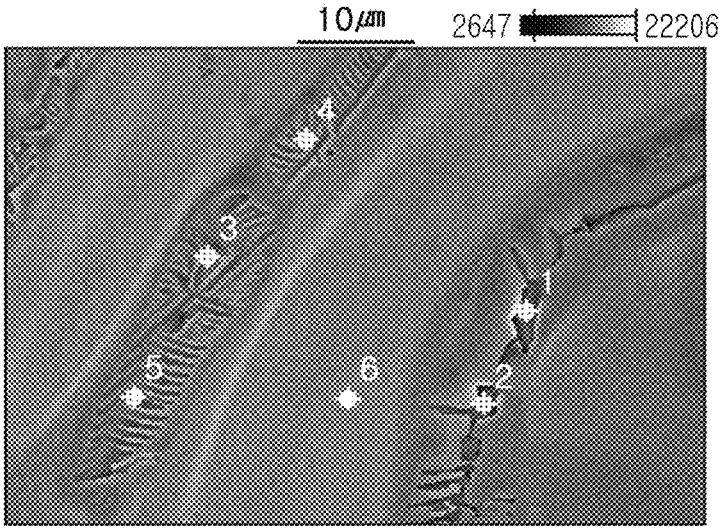
FIG. 11 is an SEM image of a plated surface of a third inventive example.

FIG. 11 is an SEM image of a plated surface of a third inventive example. As can be seen from FIG. 11, a rod-shaped crystallized matter having a length in the range of 1 to 10 μm was observed on the plated surface.

The numbers shown in FIG. 11 indicate positions analyzed by energy dispersive x-ray spectroscopy (EDS), and results of the analysis are shown in Table (2).

TABLE 2

| at. wt. % | Al-K | Mn-K | Fe-K | Zn-K | Mn/Al |
|---|---|---|---|---|---|
| pt 1 | 10.47 | 3.87 | | 85.65 | 0.369628 |
| pt 2 | 10.19 | 5.27 | 0.92 | 83.62 | 0.517174 |
| pt 3 | 3.88 | 1.44 | 1.19 | 94.68 | 0.371134 |
| pt 4 | 4 | 0.9 | 1.22 | 93.89 | 0.225 |
| pt 5 | 4 | 0.79 | 1.27 | 93.94 | 0.1975 |
| pt 6 | 1.96 | — | 1.06 | 96.99 | 0 |

In Table 2, point 6 (pt 6) represents a zinc plating layer matrix, and manganese (Mn) was not detected in the matrix. Points 1 to 5 (pt 1 to pt 5), rod-shaped crystallized matters, were Al- and Mn-containing rod-shaped crystallized matters, each having a size of 1 to 10 μm.

Figure 12:
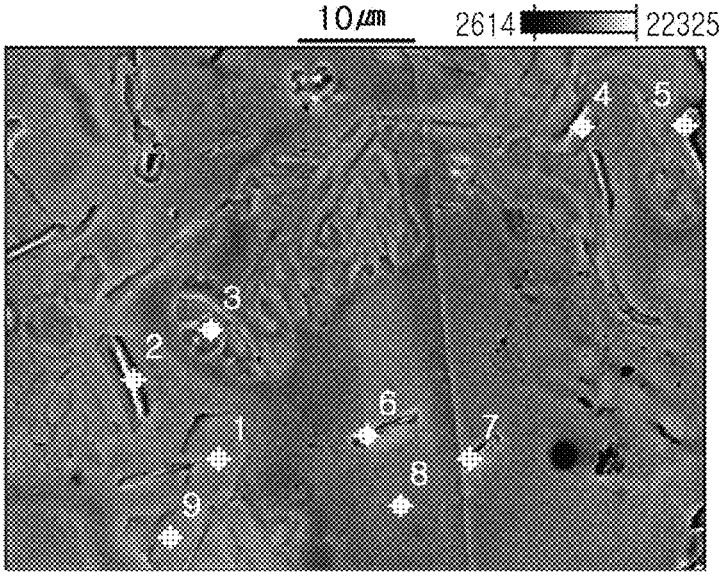
FIG. 12 is an SEM image of a plated surface of a fourth inventive example.

FIG. 12 is an SEM image of a plated surface of a fourth inventive example.

As can be seen from FIG. 12, a rod-shaped crystallized matter having a length in the range of 1 to 10 μm was observed on the plated surface. The numbers shown in FIG. 12 indicate positions analyzed by an energy dispersive x-ray spectroscopy (EDS), and results of the analysis are shown in Table (3).

TABLE (3)

| at. wt. % | O—K | Al—K | Mn—K | Fe—K | Zn—K | Mn/Al |
|---|---|---|---|---|---|---|
| pt 1 | — | 5.3 | 1.78 | 0.94 | 91.97 | 0.3358491 |
| pt 2 | — | 5.95 | 3.24 | 1.3 | 89.51 | 0.5445378 |
| pt 3 | — | 5.72 | 1.47 | — | 92.81 | 0.256993 |
| pt 4 | — | 5.4 | 2.12 | 1.39 | 91.1 | 0.3925926 |
| pt 5 | 3.38 | 2.25 | 0.59 | 0.88 | 92.91 | 0.2622222 |
| pt 6 | 3.05 | 5.45 | 1.73 | 0.77 | 88.99 | 0.3174312 |
| pt 7 | — | 5.22 | 2.25 | 0.99 | 91.54 | 0.4310345 |
| pt 8 | 1.17 | 1.32 | — | 0.7 | 96.8 | 0 |
| pt 9 | — | 4.27 | 1.73 | 0.68 | 93.32 | 0.4051522 |

In Table 3, point 8 (pt 8) represents a zinc plated layer matrix, and manganese (Mn) was not detected in the matrix. Points 1 to 7 and 9 (pt 1 to pt 7 and pt 9), rod-shaped crystallized matters, were Al- and Mn-containing rod-shaped crystallized matters, each having a size of 1 to 10 μm.

The analyses of Inventive examples 1 to 7 of the present disclosure showed that a crystallite had a major axis having a length of 1 to 20 μm on a surface of a hot-rolled galvanizing layer, and the crystallized matter contains 88 atomic percentage (at %) or more of zinc (Zn), 2 at % or more to 11 at % or less of aluminum (Al), 1 to 5 at % of manganese (Mn), and 0 to 2 at % of iron (Fe). In the crystallized matter, Mn and Al were present together and a Mn/Al at % ratio was 0.2 to 0.6.

Embodiment 2

In the second embodiment, samples were prepared by cooling a plating solution having a composition, in which aluminum (Al) was 0.22%, manganese (Mn) was 0.48%, and remainders including inevitable impurities and zinc (Zn), at different cooling rates.

In Inventive example 8, a steel sheet was cooled at a cooling rate of −5° C. in a temperature section of 420 to 418° C. Inventive example 8 was performed in the same manner as Inventive example 1, except that a steel sheet was cooled at a cooling rate of −15° C./s in Comparative Example 8.

Figure 13:
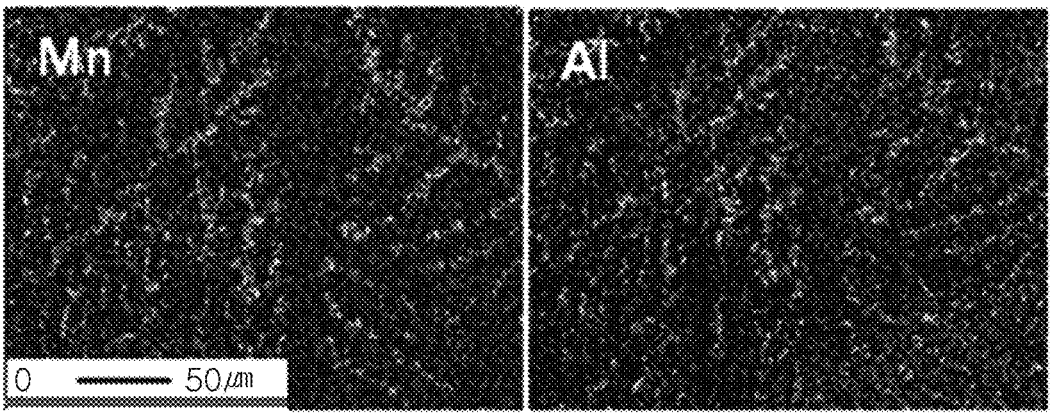
FIG. 13 illustrates a result of analyzing a plated steel sheet, obtained by an eighth inventive example of a second embodiment, using electron probe micro-analysis (EPMA).
Figure 14:
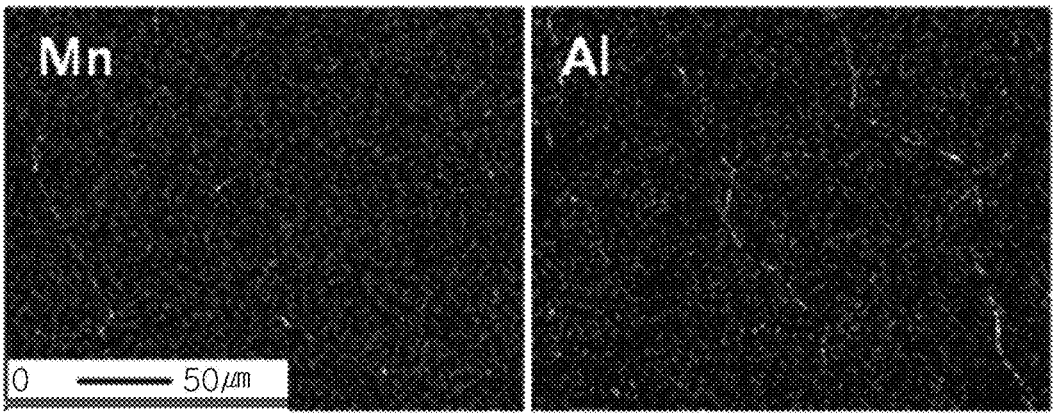
FIG. 14 illustrates a result of analyzing a plating steel sheet, obtained by an eighth comparative example of a second embodiment, using EPMA.

Plated surfaces of the obtained steel sheets were analyzed using an electron probe micro-analysis (EPMA), and results thereof are shown in FIG. 13 (Inventive example 8) and FIG. 14 (Comparative Example 8).

On the plated surface of Comparative Example 8 in which the cooling rate was high, Al and Mn were uniformly present on the surface and, even when the precipitates were present, the surface was 1 μm or less. Meanwhile, on the plated surface of Embodiment 8, Mn was segregated with Al to be crystallized. In this case, it can be seen that a crystallized position is between resin dendrites of zinc.

Accordingly, it was difficult to produce Mn crystallized matters on a plated surface obtained by performing a cooling process at a high cooling rate, and the Mn crystallized matter may be produced when the cooling rate falls within the range proposed in the present disclosure. This is because sufficient time required to diffuse Mn, discharged from a resin dendrite, to a hot-rolled galvanizing layer is secured as the resin dendrite grows during solidification.

Embodiment 3

After a cold-rolled steel sheet having a thickness of 0.75 mm was annealed in the same annealing conditions as in the first embodiment, Mn was contained in a plating solution, as follows. After being deposited in a plating bath having 0.3 wt % of Al, the annealed steel sheet was wiped to have a plating thickness of 12 μm when it is converted to Zn. In a temperature section 420 to 418° C., a cooling rate was changed, as follows. The steel sheet was cooled to 300° C. at a cooling rate of −15° C./s except for the above temperature section.

Inventive example 9: Mn 0.2 wt %, Cooling Rate −10° C./s

Comparative Example 9: Mn 0.2 wt %, Cooling Rate −20° C./s

Inventive example 10: Mn 0.4 wt %, Cooling Rate −5° C./s

Comparative Example 10: Mn 0.24 wt %, Cooling Rate −15° C./s

In the case of Comparative Examples 9 and 10 in which the cooling rate was high, a manganese (Mn) concentration from a surface portion of a plating layer to a one-tenth (1/10) point was a lowest value and was decreased as coming closer to a surface of the plating layer.

On the other hand, in Inventive examples 9 and 10, a maximum concentration value of manganese (Mn), existing in a section from a surface portion of a plating layer to a one-tenth (1/10) point in a direction of a boundary between a hot-rolled galvanizing layer and base steel, was about 110% higher than a minimum value existing in a section from a point below the above point to the boundary.

This is because if the cooling rate is increased, Mn, released from a crystallize matter of Zn when solidification nuclei are generated and grown at a boundary between a plating layer and base steel, is solidified before moving to a surface of a plating layer and thus remains in the plating layer, whereas Mn is crystallized on a surface of a plating layer since a Mn concentration in a surface portion of the plating layer is increased within a range proposed in the present disclosure.

Figure 15:
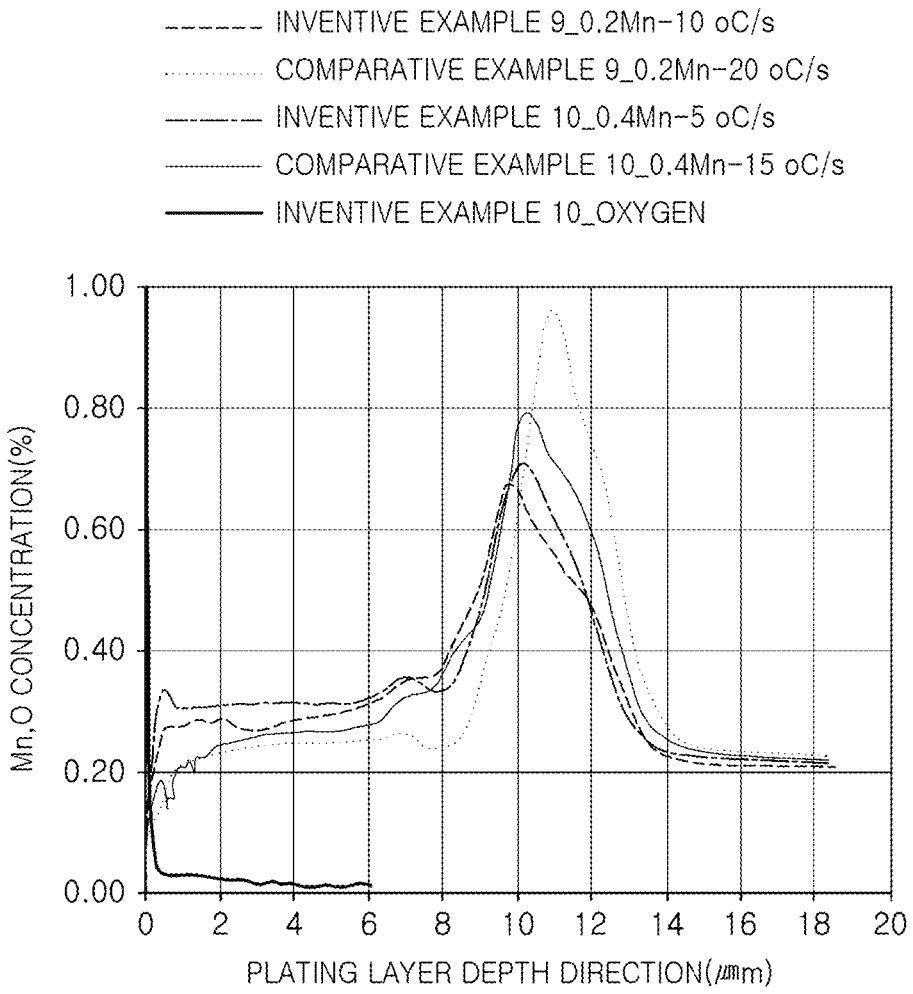
FIG. 15 illustrates a result of analyzing oxygen and manganese concentrations in a depth direction from surfaces of plating layers obtained in ninth and tenth inventive examples and ninth and tenth comparative examples of a third embodiment

In the plating layers of Inventive examples 9 and 10 and Comparative Examples 9 and 10, oxygen and manganese concentrations in a depth direction from a surface of a plating layer were analyzed, and analysis results thereof are illustrated in FIG. 15.

From the analysis result of the oxygen concentration in FIG. 15, it can be seen that a change in the oxygen concentration is irrelevant to a change in the Mn concentration in the plating layer. Accordingly, it can be seen that the Mn in a surface portion remains in a metal state without being oxidized.

Embodiment 4

Plating was performed in the same manner as in the first embodiment, except that 0.3 wt % of Al and 0.65 wt % of Mn were contained as a plating solution composition and a sample was prepared while passing through a section of 420 to 418° C. at a cooling rate of −3° C./s (Inventive example 11). In this case, the plated layer had a thickness of 8 μm.

Figure 16:
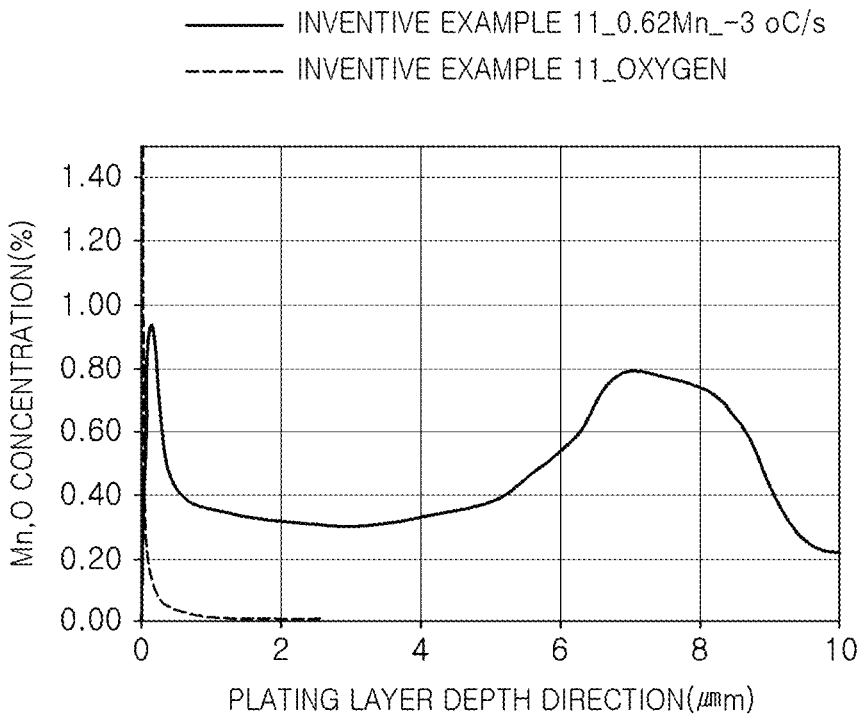
FIG. 16 illustrates a result of analyzing manganese (Mn), using a GDS, on a sample of an eleventh inventive example of a fourth embodiment.

Manganese (Mn) of the sample was analyzed using a GDS, and a result of the analysis is illustrated in FIG. 16.

As can be seen from FIG. 16, a maximum concentration value of Mn, present in a section from a surface portion of a plating layer to a one-tenth (1/10) point in a direction of a boundary between a hot-rolled galvanizing layer and a base steel, was about 0.9%. A minimum concentration value of Mn, present in a section from a point below the point to the boundary, was about 0.3%.

From these results, the maximum concentration value of the surface portion was about 300% higher than the minimum concentration value at the point therebelow.

As a result of analyzing the oxygen concentration in Inventive example 11, it can be seen that a change in the oxygen concentration is irrelevant to a change in the Mn concentration in the plating layer.

From the result, it can be seen that Mn in the surface portion layer remains in a metal state without being oxidized.

Embodiment 5

Figure 17:
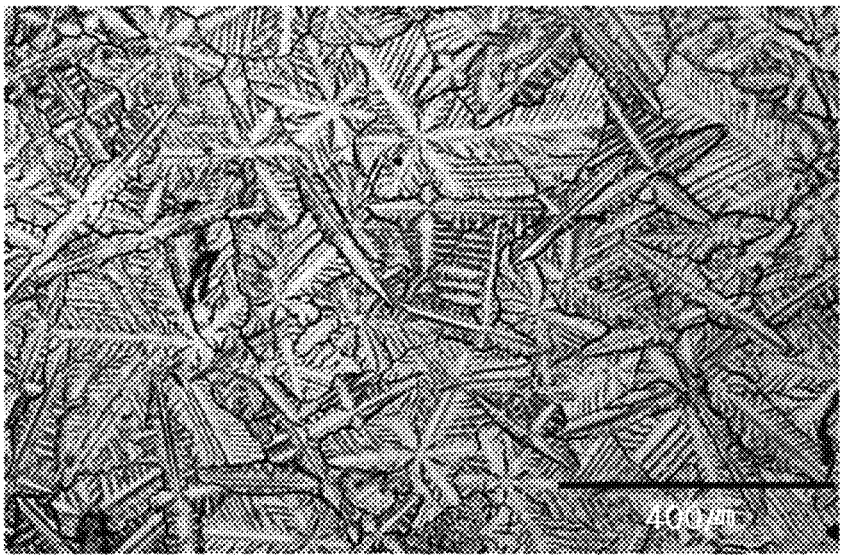
FIG. 17 is an optical microscope image illustrating a size and a shape of a spangle through measurement on a sample of a tenth inventive example of a fifth embodiment.
Figure 18:
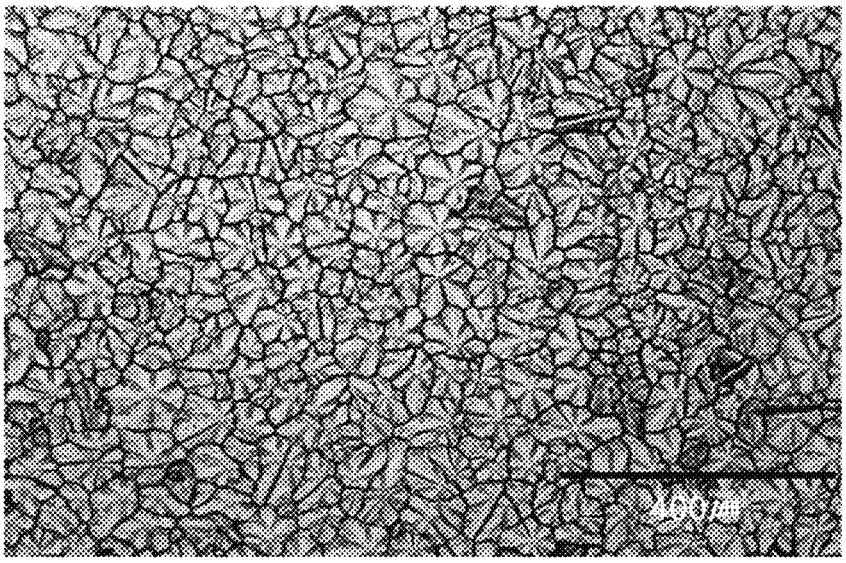
FIG. 18 is an optical microscope image illustrating a size and a shape of a spangle through measurement on a sample of a tenth comparative example of a fifth embodiment.

Sizes and shapes of spangles of the sample prepared in Inventive example 10 and Comparative Example 10 of the tenth embodiment were measured by an optical microscope, and results thereof illustrated in FIGS. 17 and 18.

As can be seen from FIGS. 17 and 18, a size of a spangle was 100 to 400 μm in Inventive example 10, and a size of a spangle was as small as 50 μm in Comparative Example 10. These results could also be confirmed from the respective Inventive examples and Comparative Examples of the first embodiment.

From these results, it could be seen that a plating layer having a size of 100 μm or less was formed when the cooling rate was higher than −10° C./s.

Embodiment 6

A surface friction coefficient, galling resistance, and sealer adhesion of the plating layers prepared in first to fifth embodiments were evaluated. All evaluated samples were subjected to skin pass rolling with a skin pass roll having a roughness of 2.0 μm to achieve uniform surface roughness a steel sheet.

A surface friction coefficient and galling resistance were evaluated, as follows.

A dynamic surface friction coefficient was measured when a bead having a vertical length of 27.5 mm and a horizontal length of 37.5 mm was placed on a sample and was moved 200 mm at a rate of 20 mm/sec with a load of 650 kilogram-force (kgf) (6.181 megapascal (MPa)). In this case, cleaning oil was applied to a test piece.

The galling resistance of the sample was estimated from a change in the friction coefficient value by continuously and repeatedly performing a friction test on the sample 40 times. When zinc adhered to the bead during the friction test, the friction coefficient value was increased. The friction coefficient was evaluated as the number of friction tests until the friction coefficient increased to 0.25. A result thereof is illustrated in Table (4).

To measure a sealer-adhesion property, a mastic sealer, commonly used in automobiles, was applied to a steel sheet between two test pieces and then annealed to be bonded. After two steel sheets are detached to be broken, a remaining state was observed. A result thereof is illustrated in Table 4.

X: an area of a plating layer exposed to one of bonded surfaces was 50% or more

Δ: the area was 10% or more to less than 50%

○: the area was 1% or more to less than 10%

◎: the plating layer was not exposed to one of the bonded surfaces, and sheet breakage occurred between adhesives.

To measure hardness (Hv) of the plating layer, plating was cut and mounted to expose a cut surface. The hardness (Hv) was measured by applying a load of 100 g to a central portion of a cross section of the plating layer while a surface was polished and magnified 1000 times. A result thereof is illustrated in Table (4).

TABLE 4

| | | Galling Resistance (Number of Continuous Friction Tests) | Surface Friction Coefficient | Sealer Adhesion Property | Hardness (Hv) of Plating Layer |
|---|---|---|---|---|---|
| Comparative Example | 1 | 22 | 0.160 | Δ | 85 |
| | 2 | 25 | 0.150 | Δ | 79 |
| | 3 | 22 | 0.150 | Δ | 80 |
| | 4 | 16 | 0.155 | ○ | 81 |
| | 5 | 20 | 0.150 | ○ | 80 |
| | 6 | 25 | 0.150 | ○ | 83 |
| | 7 | — | — | — | — |
| | 8 | 23 | 0.151 | Δ | 84 |

TABLE 4-continued

| | | Galling Resistance (Number of Continuous Friction Tests) | Surface Friction Coefficient | Sealer Adhesion Property | Hardness (Hv) of Plating Layer |
|---|---|---|---|---|---|
| | 9 | 22 | 0.15 | Δ | 81 |
| | 10 | 20 | 0.149 | x | 81 |
| Inventive example | 1 | >40 | 0.135 | ◎ | 90 |
| | 2 | >40 | 0.134 | ◎ | 91 |
| | 3 | >40 | 0.125 | ◎ | 100 |
| | 4 | >40 | 0.120 | ◎ | 110 |
| | 5 | >40 | 0.120 | ◎ | 110 |
| | 6 | >40 | 0.115 | ◎ | 125 |
| | 7 | >40 | 0.120 | ◎ | 107 |
| | 8 | >40 | 0.120 | ◎ | 105 |
| | 9 | >40 | 0.123 | ◎ | 100 |
| | 10 | >40 | 0.125 | ◎ | 115 |
| | 11 | >40 | 0.119 | ◎ | 120 |

Evaluation Result of Galling Characteristics

In all the cases of Comparative Examples 1 to 6 and 8 to 10, the galling resistance was deteriorated below 30 times.

Meanwhile, in all the inventive examples, the number of continuous friction tests in all the samples was 40 or more, exhibiting improved galling resistance.

Result of Measuring Surface Fraction Coefficient

In Comparative Examples 1 to 6 and 8 to 10, the surface friction coefficient was 0.150 or more, and exhibited a value of a surface friction coefficient of a typical hot-rolled galvanizing layer.

Meanwhile, in Inventive examples 1 to 11, a surface friction coefficient was 0.140 or less, which was excellent.

Result of Measuring Hardness

In Comparative Examples 1 to 6 and 8 to 10, a plating layer had hardness less than 90 Hv, and exhibited hardness of a plating layer of a typical hot-rolled galvanized steel sheet.

Meanwhile, in Inventive examples 1 to 11, a plating layer had hardness of 90 to 130 Hv, which was excellent. The higher a manganese (Mn) concentration of the plating layer, the greater the hardness of the plating layer.

Embodiment 7

Plating was performed in a hot-rolled galvanizing simulator. A sample used in the plating was a soft cold-rolled steel sheet, in which the content of carbon is 30 ppm or less, having a thickness of 1.2 t. The sample had a width of 150 mm and a length of 250 mm.

The plating was performed in a manner set forth below.

Foreign substances such as rolling oil, iron, and the like on a surface of a sample were deposited and removed in an aqueous solution, 10% of caustic soda, having a temperature of 50° C. After being cleaned and dried, the sample was annealed to 820° C. in a reducing atmosphere of nitrogen and oxygen.

After being cooled to reach a plating solution temperature, the annealed sample was deposited in a plating bath containing 0.15 wt % of Al and 0.45 wt % of Mn, a remainder of Zn, and inevitable impurities. After the deposited sample is taken out of the plating bath, nitrogen and air were blown onto a steel sheet, taken up from a plating pot, to remove excessive molten zinc. After adhering to the steel sheet, a plating layer in a molten state was solidified to from a plating layer.

Cooling of the plating layer was performed in a manner set forth below.

Inventive example 12: Wiping was performed after plating. After being cooled at a cooling rate of −10° C./s until a steel sheet reached 420° C., the plating layer was cooled at a cooling rate of −3° C./s until the steel sheet reached 418° C. Then, the plating layer was cooled at a cooling rate of −15° C./s.

Comparative Example 11: A plating layer was naturally cooled.

Components of the plating layers, obtained Inventive example 12 and Comparative Example 11, were analyzed. Results of the analyses are illustrated in Table (5).

Comparative Example 11 exhibited higher content of iron (Fe) than Inventive example 12. This is because much time is taken until the plating layer was solidified, and thus, an alloying reaction occurs between a base steel and the molten plating layer.

TABLE 5

| | Cooling Method | Al (wt %) | Mn (wt %) | Fe (wt %) | Zn (wt %) |
|---|---|---|---|---|---|
| Comparative Example 11 | Natural Cooling | 0.31 | 0.58 | 7.41 | 91.7 |
| Inventive example 12 | Cooling Rate is controlled by blowing air | 0.35 | 0.48 | 0.42 | 98.75 |

Figure 19:
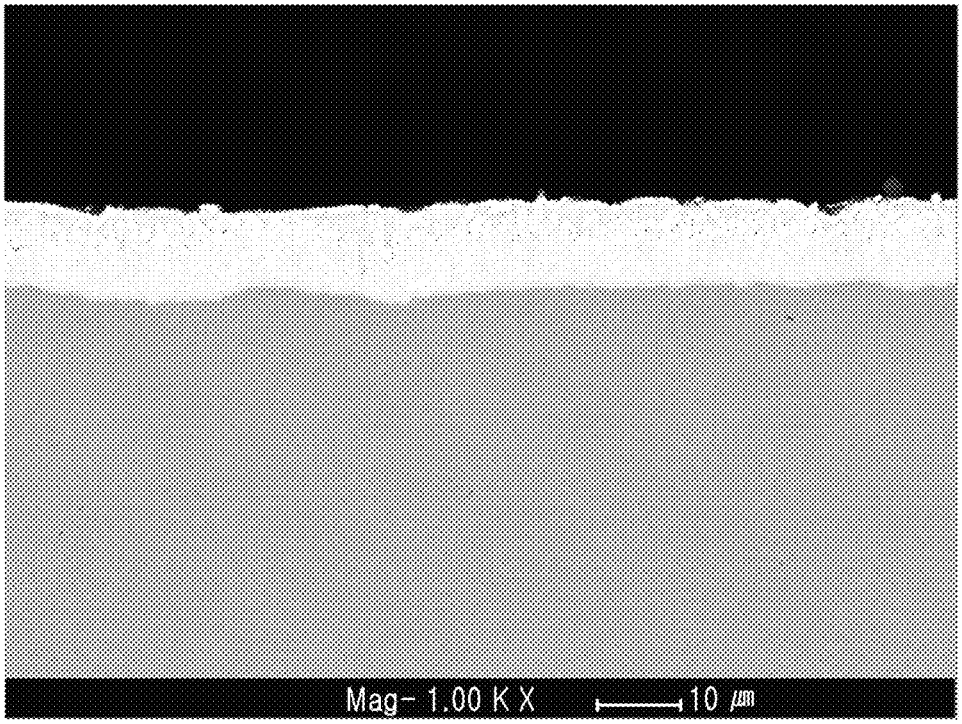
FIG. 19 is an SEM image illustrating a cross section of a plating steel sheet obtained by an eleventh comparative example.
Figure 20:
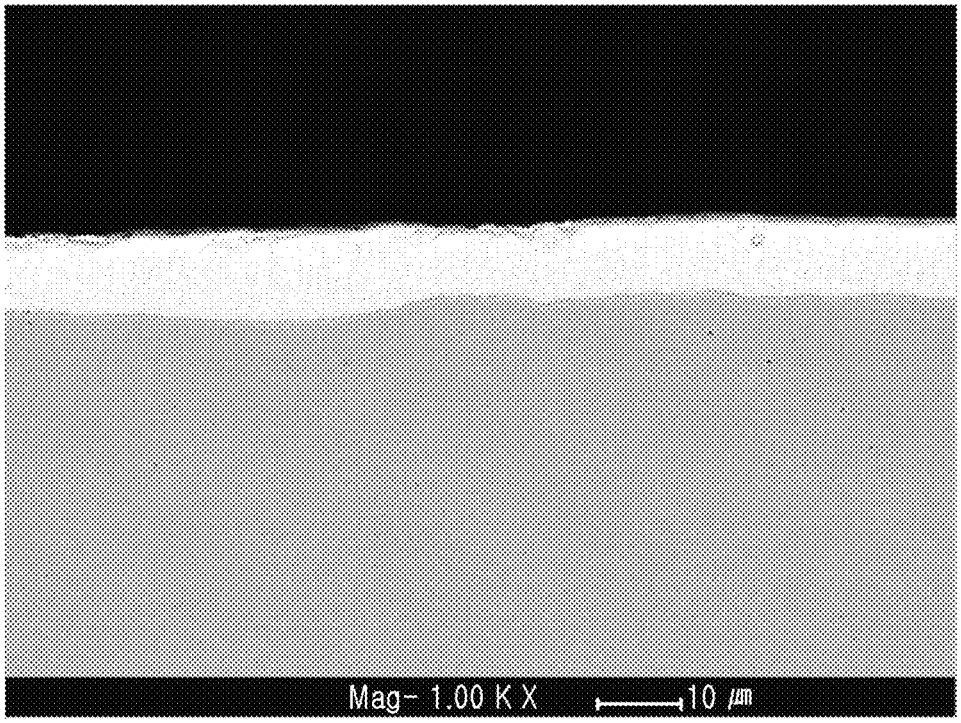
FIG. 20 is an SEM image illustrating a cross section of a plating steel sheet obtained by a twelfth inventive example.

Cross sections of plated steel sheets obtained in Comparative Example 11 and Inventive example 12 were captured by an electron microscope, and the captured images thereof are shown in FIGS. 19 and 20. From FIG. 19 showing the cross-section of Comparative Example 11, it could be confirmed that a zinc-iron alloy was formed in a plating layer, whereas from FIG. 20 showing the cross section of Inventive example 12, it could not be confirmed that such an alloy phase existed.

Figure 21:
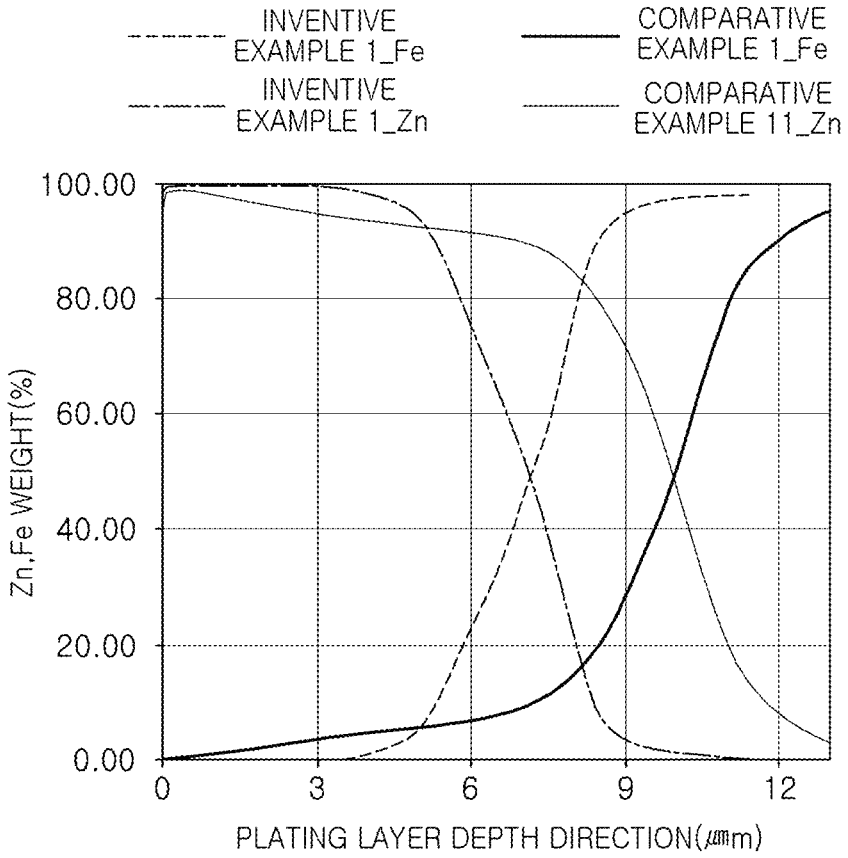
FIG. 21 illustrates a result of analyzing concentrations of zinc and iron on steel sheets of the eleventh comparative example and the twelfth inventive example, using a GDS, in a depth direction of a plating layer.

Concentrations of zinc and iron in the steel sheets of Comparative Example 11 and Inventive example 12 in a plating layer depth direction were analyzed by GDS, and the results thereof are illustrated in FIG. 21. From FIG. 21, it can be confirmed that when natural cooling is performed as in Comparative Example 11, it took lots of time for solidification, and thus, an alloying reaction occurred between molten zinc and iron to diffuse Fe from a base steel to a surface of the plating layer.

Figure 22:
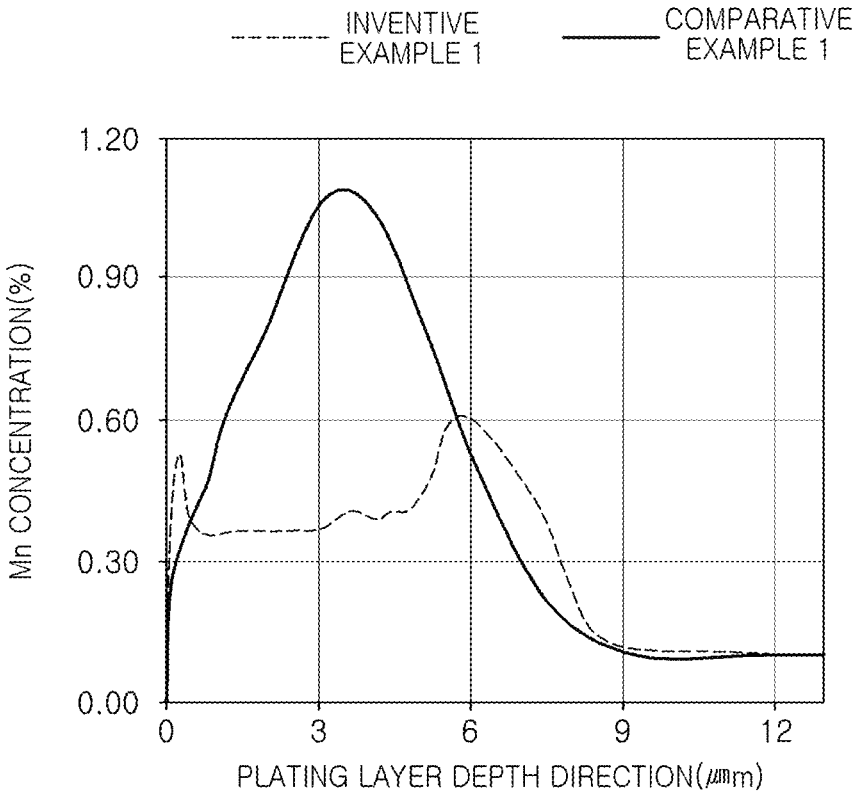
FIG. 22 illustrates a result of analyzing a concentration of manganese (Mn) in a plating layer on steel sheets of the eleventh comparative example and the twelfth inventive example, using a GDS, in a depth direction of the plating layer.

In addition, concentrations of manganese (Mn) in the plating layers of the steel sheets of Comparative Example 11 and Inventive example 12 in the plating layer depth direction were analyzed by the GDS, and results thereof are illustrated in FIG. 22. From FIG. 22, it could be confirmed that in Comparative Example 11, Mn has a maximum concentration in a center of the plating layer and then was rapidly decreased, whereas Inventive example 12 had a Mn concentration change value proposed in the present disclosure.

The reason for the above is unclear, but is presumed as follows. For example, when natural cooling is performed, a significant amount of time is required until the plating layer is solidified. Thus, a zinc-iron alloying reaction occurs. For example, when the plating layer is solidified, a resin dendrite of Zn is not grown and a Zn—Fe alloy phase having a high melting point is formed and solidified. Accordingly, since Mn discharge caused by growth of the resin dendrite does not occur, a Mn crystallite is not formed.

As can be seen From FIG. 22, a content of Mn in the plating layer was higher in Comparative Example 11 than in Inventive example. This is because Mn contained in the steel was included in the plating layer when the iron was alloyed by molten zinc.

An O-T bending tests was on the steel sheets obtained in Comparative Example 11 and Inventive example 12.

Figure 23:
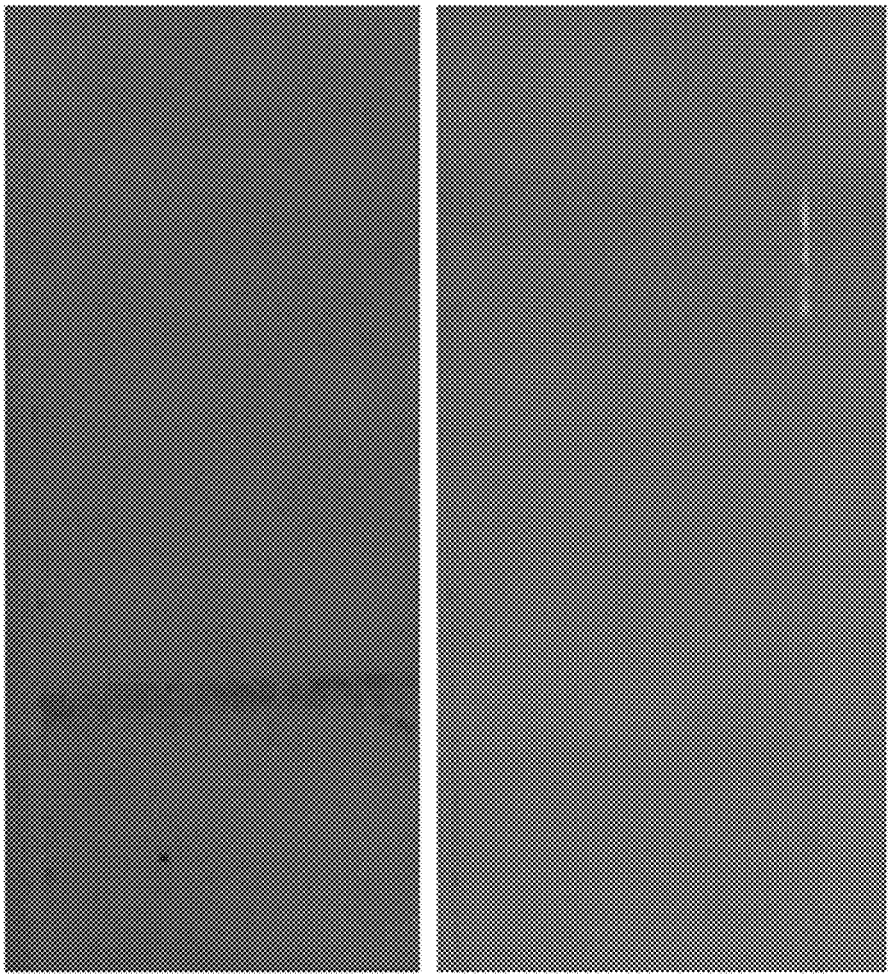
FIG. 23 is a captured image of a surface of a sample when attaching cellophane tape to the sample and detaching the attached cellophane tape after performing an O-T bending test on steel sheets of the eleventh comparative example and the twelfth inventive example.

After performing the O-T bending test, cellophane tape was attached to a sample. After the cellophane tape was detached, a surface of the sample was captured and a result thereof is illustrated in FIG. 23. As can be seen from FIG. 23, a plating layer was delaminated in a sample of Comparative Example 11, whereas a sample exhibited an improved result without being delaminated.

The invention claimed is:

1. A method for manufacturing a hot-rolled galvanized steel sheet, the method comprising:

a plating layer forming step of depositing a steel sheet in a hot-rolled galvanizing solution, containing 0.1 to 0.8 weight percentage (wt %) of aluminum (Al), 0.05 to 1 wt % of manganese (Mn), with a remainder of zinc (Zn) and inevitable impurities, and taking out the deposited steel sheet therefrom to form a plating layer that forms a hot-rolled galvanizing layer;

a primary cooling step of cooling the steel sheet, on which the hot-rolled galvanizing layer is formed, at a cooling rate of −10 degrees Celsius per second (° C./s) until a temperature of the steel sheet reaches 420° C.;

a secondary cooling step of cooling the steel sheet at a cooling rate of −8° C./s until the temperature of the steel sheet reaches 418° C. from 420° C.; and a tertiary cooling step of cooling the steel sheet at a steel sheet temperature of 418° C. or less at a cooling rate of −10° C./s or more to form the hot-rolled galvanizing layer.

2. The method of claim 1, wherein the hot-rolled galvanizing solution has a temperature of 440 to 470° C.

3. The method of claim 1, further comprising:

a wiping step of blowing nitrogen or air to the steel sheet, taken out from the hot-rolled galvanizing solution, to remove excessive molten zinc adhered to the steel sheet while cooling the steel sheet.

4. The method of claim 1, wherein the secondary cooling step is performed by blowing a gas having a temperature ranging from 100° C. to 400° C.

5. The method of claim 4, wherein the gas is air or a nitrogen gas.

6. The method of claim 1, further comprising:

cleaning a surface of the steel sheet to remove foreign substances before the plating layer forming step;

annealing the steel sheet in a nitrogen-hydrogen reducing atmosphere at an A3 transformation temperature or higher; and cooling the annealed steel sheet before being deposited in the hot-rolled galvanizing solution.

7. The method of claim 1, further comprising:

temper-rolling a surface of a solidified hot-rolled galvanizing layer after the tertiary cooling step.

8. The method of claim 1, wherein the hot-rolled galvanizing solution contains 0.15 to 0.5 wt % of Al, 0.05 to 0.6 wt % of Mn, and a remainder of Zn, and a total content of elements excluding Zn is 1 wt % or less.

* * * * *